US007159970B2

(12) United States Patent
Watanabe

(10) Patent No.: US 7,159,970 B2
(45) Date of Patent: Jan. 9, 2007

(54) INK-JET HEAD

(75) Inventor: Hidetoshi Watanabe, Tokoname (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 217 days.

(21) Appl. No.: 10/912,239

(22) Filed: Aug. 6, 2004

(65) Prior Publication Data

US 2005/0036006 A1 Feb. 17, 2005

(30) Foreign Application Priority Data

Aug. 14, 2003 (JP) ..... 2003-293358

(51) Int. Cl.
*B41J 2/045* (2006.01)

(52) U.S. Cl. ..... 347/68

(58) Field of Classification Search ..... 347/68–72; 29/25.35

See application file for complete search history.

(56) References Cited

U.S. PATENT DOCUMENTS

| | | | | |
|---|---|---|---|---|
| 5,963,234 | A | 10/1999 | Miyazawa et al. | |
| 6,174,051 | B1 * | 1/2001 | Sakaida | 347/72 |
| 6,364,468 | B1 * | 4/2002 | Watanabe et al. | 347/68 |
| 6,905,202 | B1 * | 6/2005 | Shimamoto et al. | 347/94 |

FOREIGN PATENT DOCUMENTS

| | | |
|---|---|---|
| EP | 0 759 361 A2 | 2/1997 |
| JP | A 9-314836 | 12/1997 |

* cited by examiner

*Primary Examiner*—An H. Do
(74) *Attorney, Agent, or Firm*—Oliff & Berridge, PLC

(57) ABSTRACT

A flow path unit is provided with an individual ink flow path including a pressure chamber opposite to a sub-manifold 5*a* and an individual ink flow path including a pressure chamber not opposite to the sub-manifold. The sub-manifold is provided with a beam connecting an upper surface and a lower surface of the sub-manifold.

20 Claims, 17 Drawing Sheets

INK-JET HEAD

BACKGROUND OF THE INVENTION

1. Field of the Invention

The present invention relates to an ink-jet head used in an ink-jet recording apparatus for discharging ink to print on a recording medium.

2. Description of the Related Art

JP-A-9-314836 (FIG. 1, FIG. 2) discloses an ink-jet head in which ink is distributed from a common ink chamber to each of plural pressure chambers, that is, pressure generation chambers arranged in one direction. In such an ink-jet head, an actuator unit including a piezoelectric diaphragm is bonded to a flow path unit in which a common ink chamber and nozzles are formed. When pressure is applied to ink in an arbitrary pressure chamber selected from the plural pressure chambers by the piezoelectric diaphragm, the ink is discharged from the nozzle connected to the pressure chamber. In a portion sandwiched between the pressure chamber and the common ink chamber in the flow path unit, there is provided a recess for suppressing crosstalk in which a vibration generated in a pressure chamber is transmitted to the common ink chamber to induce a pressure change in the other pressure chamber. In the ink-jet head 1 disclosed in JP-A-9-314836, all the pressure chambers are opposite to the common ink chamber, and any pressure chambers have the same positional relation with respect to the common ink chamber. Besides, the shapes of the recesses are the same for all the pressure chambers.

In recent years, in order to improve printing resolution and printing speed, an attempt has been made to arrange pressure chambers in a matrix form along a plane, that is, two-dimensionally in two directions. In this case, since it is necessary to arrange nozzles so that ink is discharged in a direction vertical to the plane on which the pressure chambers are arranged, a common ink chamber can not be provided so as to be opposite to all the pressure chambers. Accordingly, two kinds of pressure chambers are inevitably produced, that is, some pressure chambers are opposite to the common ink chamber and others are not opposite to the common ink chamber. In the two kinds of pressure chambers, each of the pressure chambers opposite to the common ink chamber has a relatively large compliance (reciprocal of rigidity) at the time of an ink discharge operation, however, each of the pressure chambers not opposite to the common ink chamber has a relatively small compliance at the time of the ink discharge operation. The difference in compliance as stated above emerges as a difference in ink discharge speed and causes degradation in picture quality.

SUMMARY OF THE INVENTION

The present invention provides an ink-jet head in which a difference in compliance between pressure chambers due to a difference in positional relation of the pressure chambers to a common ink chamber is reduced and ink discharge speeds from nozzles can be made almost uniform.

According to one aspect of the invention, an ink-jet head includes a flow path unit including a common ink chamber and plural individual ink flow paths extending from outlets of the common ink chamber through pressure chambers to nozzles, the plural pressure chambers being arranged along a plane so that positional relations between the common ink chamber and the pressure chambers are different from each other in the plural individual ink flow paths, and an actuator unit fixed to one surface of the flow path unit and for changing volumes of the pressure chambers. A reinforcing part for reducing a difference in compliance between the plural pressure chambers corresponding to the plural individual ink flow paths having the different positional relations is provided in the common ink chamber.

By this, the difference in compliance between the pressure chambers due to the difference in positional relation of the pressure chambers to the common ink chamber is reduced, and ink discharge speeds from the nozzles can be made almost uniform. Accordingly, variations in the ink discharge speeds from the nozzles are reduced, and the quality of a printing image by the ink-jet head is improved.

According to another aspect of the invention, it is preferable that the reinforcing part is provided to be connected to a part of at least a wall surface, at a side of the one surface, of two wall surfaces opposite to the one surface among wall surfaces of the common ink chamber. By this, the structure of the reinforcing part becomes simple and is easy to produce.

According to another aspect of the invention, it is preferable that the reinforcing part is provided in the common ink chamber to connect plural wall surfaces not existing on a same plane. By this, it becomes possible to effectively decrease the difference in compliance between the pressure chambers due to the difference in positional relation of the pressure chambers to the common ink chamber.

The reinforcing part may be connected between the two wall surfaces opposite to the one surface among the wall surfaces of the common ink chamber. By this, it becomes possible to more effectively decrease the difference in compliance between the pressure chambers due to the difference in positional relation of the pressure chambers to the common ink chamber.

The reinforcing part may include a beam separate from wall surfaces crossing the two opposite wall surfaces among the wall surfaces of the common ink chamber. By this, since the arrangement pitch of the pressure chambers along the common ink chamber may not be considered, the design is easy.

The beam may extend in parallel to a flow direction of ink flowing in the common ink chamber. By this, in a case where the extension direction of the common ink chamber and the arrangement direction of the pressure chambers are parallel to each other, the difference in compliance can be effectively eliminated.

A plurality of the beams parallel to each other may be provided. By this, in a case where two or more lines of pressure chambers are provided in the common ink chamber, the difference in compliance can be effectively eliminated.

The wall surfaces crossing the two opposite wall surfaces among the wall surfaces of the common ink chamber and the beam may be partially connected to each other in an extension direction of the beam. By this, while a flow path resistance in the common ink chamber is kept at a small value, the common ink chamber including the beam can be easily produced.

The reinforcing part may include plural protrusions which protrude from at least one of two wall surfaces crossing the two opposite wall surfaces among the wall surfaces of the common ink chamber and are separate from each other in an extension direction of the common ink chamber. By this, it becomes possible to effectively reduce the difference in compliance between the pressure chambers due to the difference in positional relation of the pressure chambers to the common ink chamber by the protrusions.

Plural protrusions may protrude from at least two wall surfaces crossing the two opposite wall surfaces among the wall surfaces of the common ink chamber. By this, in the case where two or more lines of pressure chambers are provided in the common ink chamber, the difference in compliance can be effectively eliminated.

According to another aspect, an ink-jet head includes a flow path unit in which plural individual ink flow paths respectively including pressure chambers are formed, and an actuator unit fixed to one surface of the flow path unit and for changing volumes of the pressure chambers, and the flow path unit includes plural nozzles for discharging ink, plural pressure chamber lines extending in parallel to each other, in which the plural pressure chambers communicating with the nozzles and each having a rectangular plane shape having two acute angle parts at a diagonal are arranged to be adjacent to each other, and plural common ink flow paths extending in a direction parallel to the plural pressure chamber lines. The plural pressure chamber lines include a first pressure chamber line formed of plural first pressure chambers in each of which one of acute angle parts communicates with a first nozzle and the other of the acute angle parts communicates with the common ink flow path, a second pressure chamber line adjacent to the first pressure chambers and formed of plural second pressure chambers in each of which one of acute angle parts communicates with a second nozzle, and the other of the acute angle parts communicates with the common ink flow path, a third pressure chamber line adjacent to the second pressure chambers and formed of plural third pressure chambers in each of which one of acute angle parts communicates with the common ink flow path, and the other of the acute angle parts communicates with a third nozzle, and a fourth pressure chamber line adjacent to the third pressure chambers and formed of plural fourth pressure chambers in each of which one of acute angle parts communicates with the common ink flow path, and the other of the acute angle parts communicates with a fourth nozzle, and a reinforcing part for reducing a difference in compliance between the first to the fourth pressure chambers is provided in the common ink chamber. By this, the difference in compliance between the pressure chambers due to the difference in positional relation of the pressure chambers to the common ink chamber is reduced, and ink discharges speeds from the nozzles can be made almost uniform.

According to another aspect of the invention, he reinforcing part includes a beam which connects two wall surfaces opposite to the one surface among wall surfaces of the common ink chamber, is separate from two wall surfaces crossing the two opposite wall surfaces, and extends in parallel to a flow direction of ink flowing in the common ink chamber. It is preferable that outlets of the common ink chamber respectively communicating with the first to the fourth pressure chambers are provided at positions not overlapping with the beam. By this, since the outlets of the common ink chamber and the reinforcing part do not overlap with each other, when ink in the common ink chamber is supplied to the pressure chambers, it is possible to prevent insufficient ink supply (under refill) from occurring.

According to another aspect of the invention, the reinforcing part includes plural protrusions which connect two wall surfaces opposite to the one surface among wall surfaces of the common ink chamber, protrude from at least one of two wall surfaces crossing the two opposite wall surfaces, and are separate from each other in an extension direction of the common ink chamber. It is preferable that the plural protrusions are provided at a same pitch as an arrangement pitch of the pressure chambers in the first to the fourth pressure chamber lines. Since the pitch of the protrusions is determined by this, the design can be easily made, and the difference in compliance can be effectively eliminated by the protrusions.

BRIEF DESCRIPTION OF THE DRAWINGS

FIG. 11 is enlarged views of a portion surrounded by a one-dot-chain line in FIG. 6, in which

DESCRIPTION OF THE PREFERRED EMBODIMENTS

Hereinafter, preferred embodiments of the present invention will be described with reference to the drawings.

Figure 1:
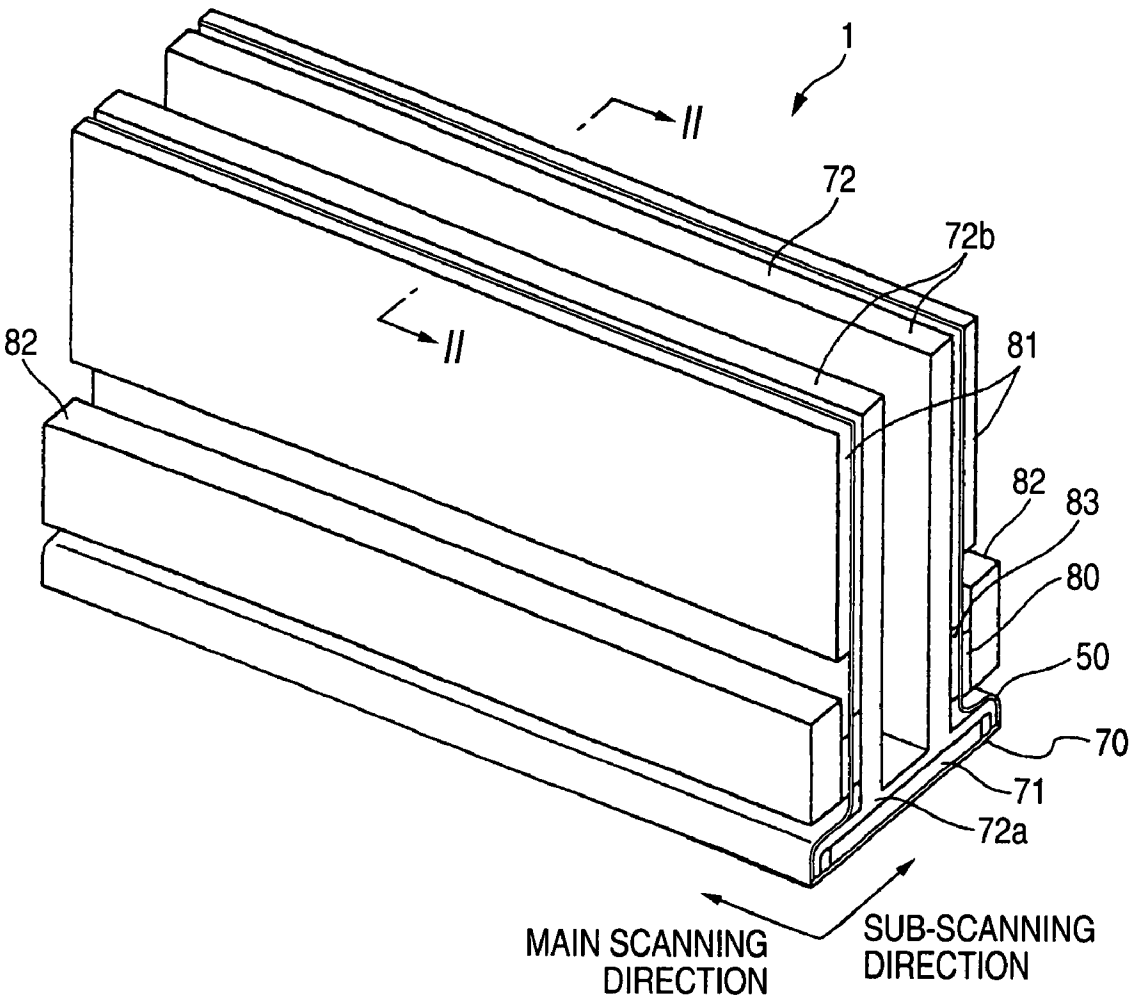
FIG. 1 is an outside perspective view of an ink-jet head according to a first embodiment of the invention.
Figure 2:
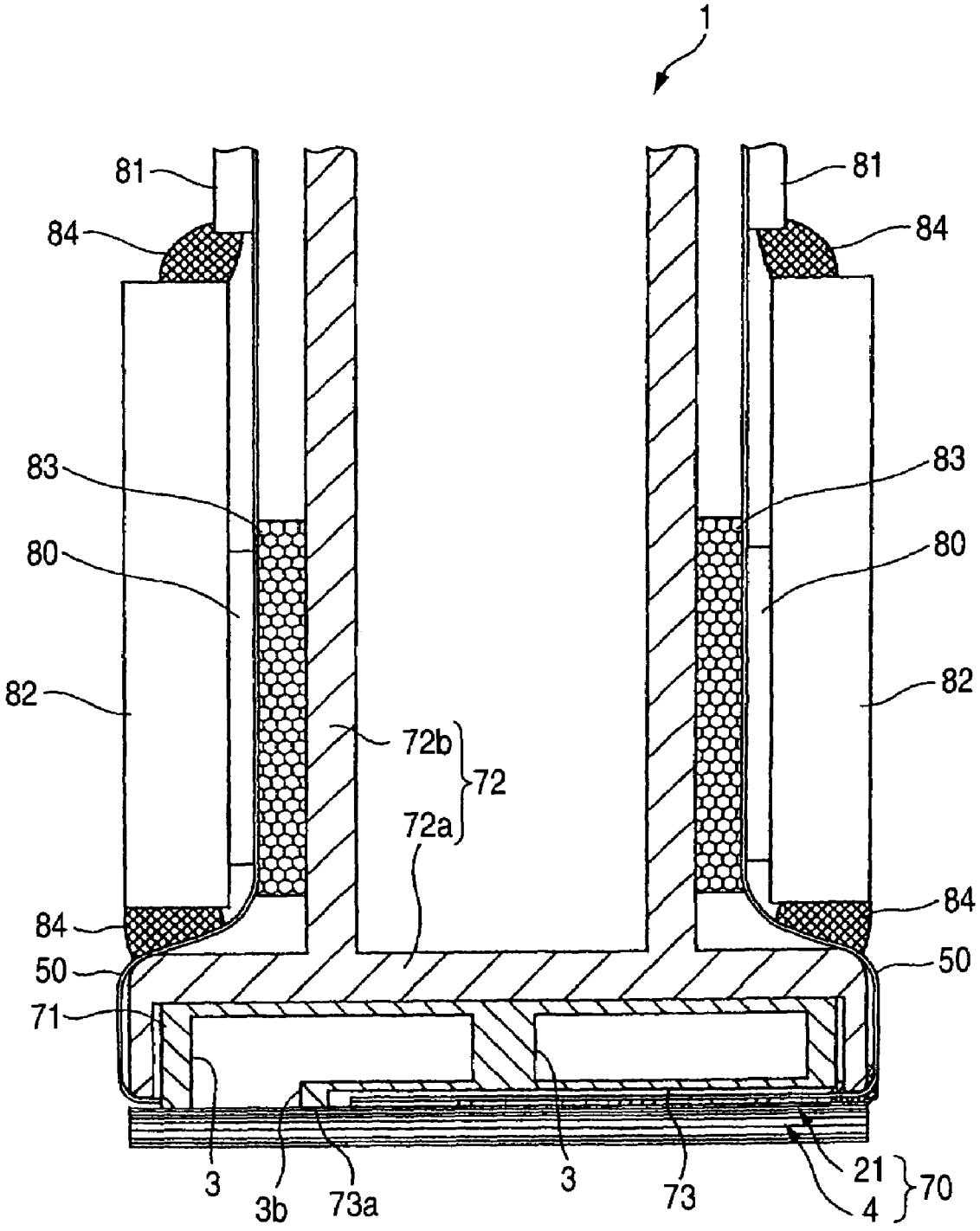
FIG. 2 is a sectional view, taken along line II—II of FIG. 1.

FIG. 1 is an outside perspective view of an ink-jet head according to a first embodiment of the invention FIG. 2 is a sectional view taken along line II—II of FIG. 1. An ink-jet head 1 includes a head main body 70 for discharging ink to a sheet, which extends in a main scanning direction and has a rectangular plane shape, and a base block 71 which is disposed above the head main body 70 and in which ink reservoirs 3 as flow paths of ink supplied to the head main body 70 are formed.

The head main body 70 includes a flow path unit 4 in which ink flow paths are formed, and plural actuator units 21 bonded to the upper surface of the flow path unit 4. The flow path unit 4 and the actuator units 21 are constructed such that plural sheet-like members are laminated and bonded to each other. A flexible printed circuit (FPC: Flexible Printed Circuit) 50 as a feeding member is bonded to the upper surfaces of the actuator units 21, and the FPC 50 is led out to the upper part while being bent in FIG. 2. The base block 71 is made of metal material, for example, stainless. The ink reservoir 3 in the base block 71 is substantially a rectangular parallelepiped hollow area formed in the longitudinal direction of the base block 71.

A lower surface 73 of the base block 71 protrudes downward from a surrounding area in the vicinity of an opening 3*b*. The base block 71 is in contact with the flow path unit 4 only at a portion 73*a* near the opening 3*b* of the lower surface 73. Thus, an area other than the portion 73*a* near the opening 3*b* of the lower surface 73 of the base block 71 is separate from the head main body 70, and the actuator unit 21 is disposed in this separate portion.

The base block 71 is bonded and fixed to a recess formed in the lower surface of a grip part 72*a* of a holder 72. The holder 72 includes the grip part 72*a* and a pair of flat-shaped protrusions 72*b* extending from the upper surface of the grip part 72*a* in a direction orthogonal to this and spaced from each other by a specified interval. The FPC 50 bonded to the actuator units 21 is arranged along the surface of each of the projections 72*b* of the holder 72 through an elastic member 83 such as a sponge. A driver IC 80 is disposed on the FPC 50 arranged on the surface of the projection 72*b* of the holder 72. In order to send drive signals outputted from the driver IC 80 to the actuator units 21 (described later in detail) of the head main body 70, the FPC 50 is electrically connected to both by soldering.

Since a heat sink 82 having substantially a rectangular parallelepiped shape is disposed to be in close contact with the outer surface of the driver IC 80, heat generated by the driver IC 80 can be efficiently dissipated. A board 81 is disposed above the driver IC 80 and the heat sink 82 and outside the FPC 50. Seal members 84 are respectively disposed between the upper surface of the heat sink 82 and the board 81, and between the lower surface of the heat sink 82 and the FPC 50, and they are respectively bonded to each other by the seal members 84.

Figure 3:
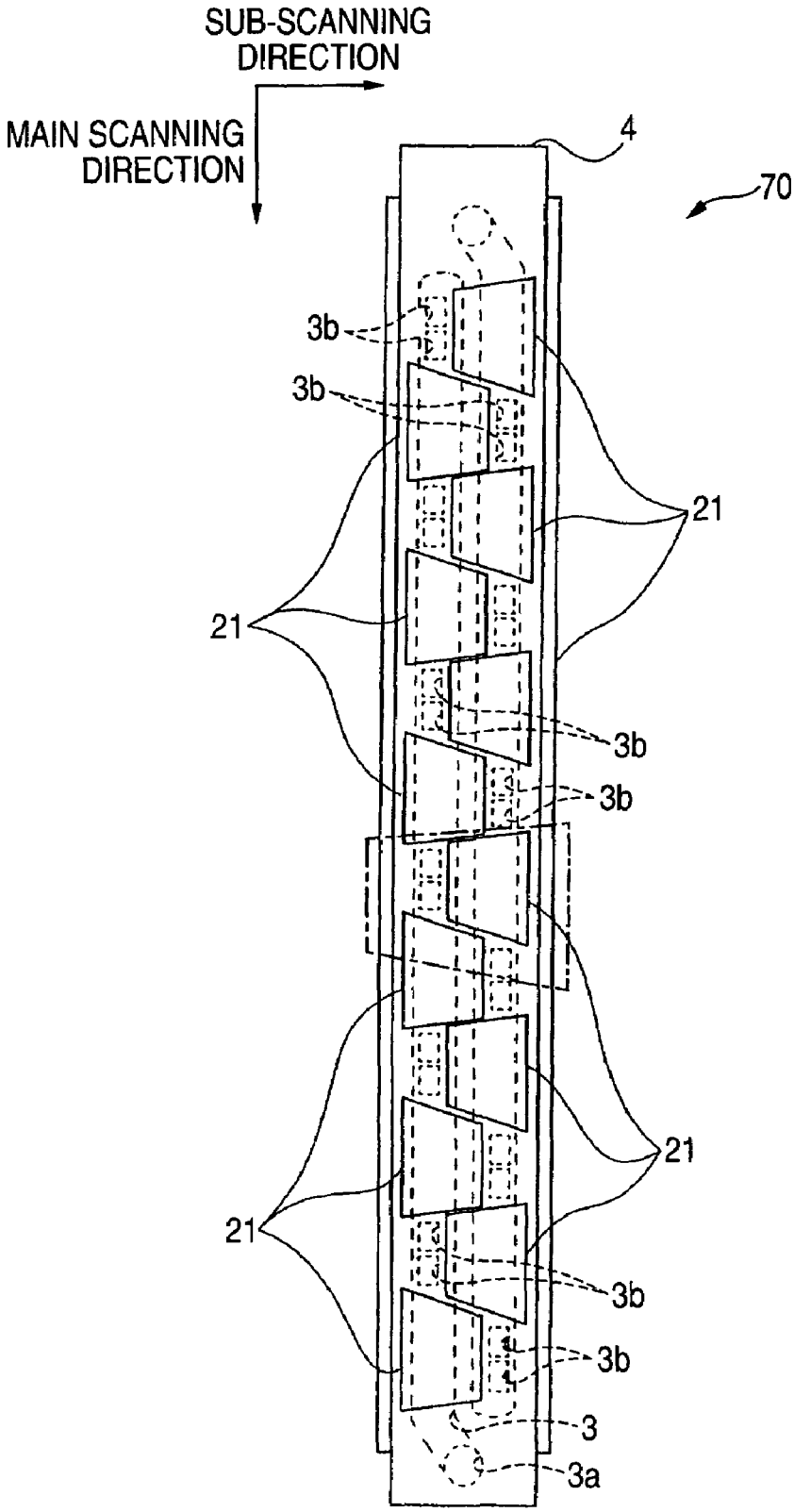
FIG. 3 is a plan view of a head main body included in the ink-jet head shown in FIG. 2.

FIG. 3 is a plan view of the head main body included in the ink-jet head shown in FIG. 2. In FIG. 3, the ink reservoirs 3 formed in the base block 71 are imaginarily shown by broken lines. The two ink reservoirs 3 extend in parallel to each other in the longitudinal direction of the head main body 70 and are spaced from each other by a specified interval. Each of the two ink reservoirs 3 has an opening 3*a* at one end and communicates with an ink tank (not shown) through this opening 3*a*, so that it is always filled with ink. The many openings 3*b* are provided for the respective ink reservoirs 3 in the longitudinal direction of the head main body 70, and connect the respective ink reservoirs 3 and the flow path unit 4 as described above. The many openings 3*b* include pairs and the two openings of each of the pairs are disposed to be close to each other in the longitudinal direction of the head main body 70. The pairs of the openings 3*b* communicating with the one ink reservoir 3 and the pairs of the openings 3*b* communicating with the other ink reservoir 3 are arranged in a staggered manner.

In the areas where the openings 3*b* are not arranged, the plural actuator units 21 having trapezoidal plane shapes are arranged in a staggered manner and in a pattern opposite to the pairs of the openings 3*b*. Parallel opposite sides (upper side and lower side) of each of the actuator units 21 are parallel to the longitudinal direction of the head main body 70. Parts of oblique sides of the adjacent actuator units 21 overlap with each other in the width direction of the head main body 70.

Figure 4:
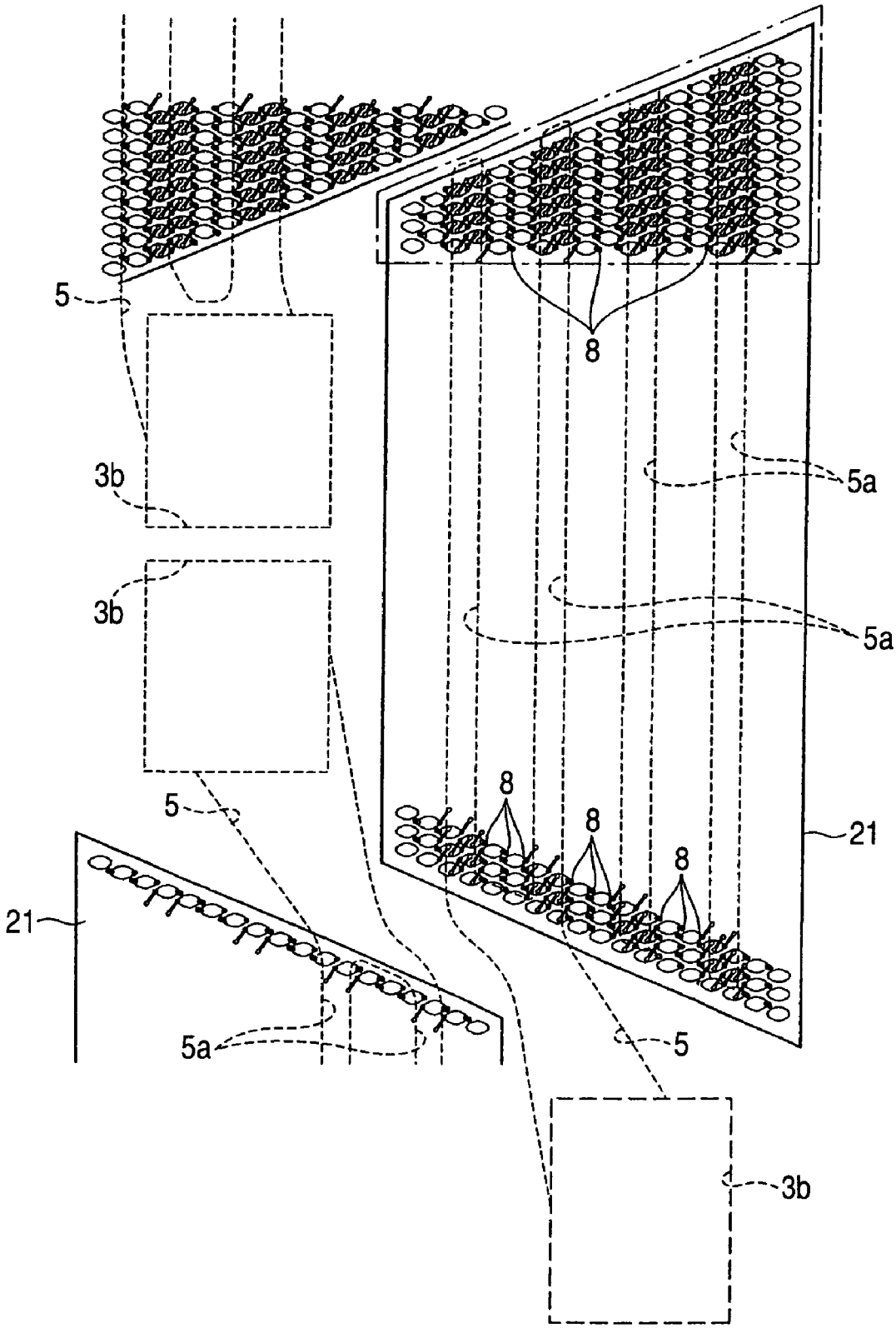
FIG. 4 is an enlarged view of an area surrounded by a one-dot chain line of FIG. 3.

FIG. 4 is an enlarged view of an area surrounded by a one-dot chain line drawn in FIG. 3. As shown in FIG. 4, the openings 3*b* provided for each of the ink reservoirs 3 communicate with manifolds 5 as common ink chambers, and a tip end of each of the manifolds 5 branches into two and forms sub-manifolds 5*a*. Besides, when viewed on a plane, the two sub-manifolds 5*a* branching from the adjacent opening 3*b* extend from each of the two oblique sides of the actuator unit 21. That is, under the actuator unit 21, the four sub-manifolds 5*a* separate from each other extend along the parallel opposite sides of the actuator unit 21. Incidentally, the sub-manifolds 5*a* are common ink flow paths of the manifold 5 as the common ink chamber.

The lower surface of the flow path unit 4 corresponding to the bonded area of the actuator unit 21 is an ink discharge area. Many nozzles 8 are arranged in a matrix form on the surface of the ink discharge area as described later. For the purpose of simplifying the drawing, only some of the nozzles 8 are shown in FIG. 4, however, they are actually arranged all over the ink discharge area.

Figure 5:
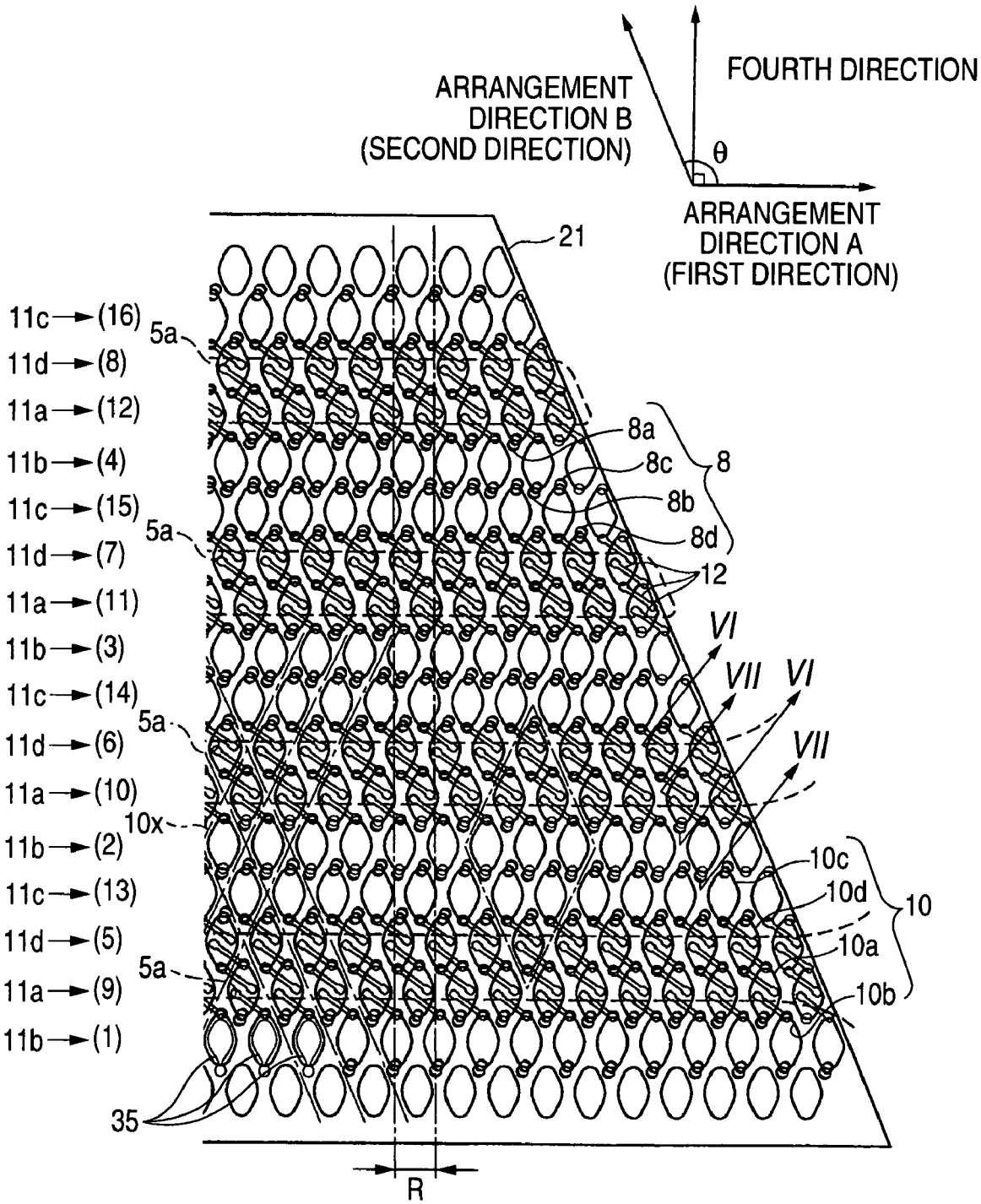
FIG. 5 is an enlarged view of an area surrounded by a one-dot chain line of FIG. 4.

FIG. 5 is an enlarged view of an area surrounded by a one-dot chain line drawn in FIG. 4. FIGS. 4 and 5 show a state where a plane on which many pressure chambers 10 of the flow path unit 4 are arranged in a matrix form is seen in a direction vertical to the ink discharge surface. Each of the pressure chambers 10 has a rhombic plane shape in which radius is given to each corner part, and a longer diagonal line is parallel to the width direction of the flow path unit 4. One end of each of the pressure chambers 10 corresponding to one acute angle part of the pressure chamber 10 communicates with the nozzle 8, and the other end corresponding to the other acute angle part of the pressure chamber 10 communicates with the sub-manifold 5*a* through an aperture 12. When viewed on a plane, at a position overlapping with each of the pressure chambers 10, an individual electrode 35 having a plane shape similar to the pressure chamber 10 and one size smaller than this is formed on the actuator unit 21. FIG. 5 shows only some of the many individual electrodes 35 to simplify the drawing. Incidentally, in FIGS. 4 and 5, for the purpose of making the drawings plain, the pressure chambers 10, the apertures 12 and the like which exist in the actuator unit 21 or the flow path unit 4 and should be drawn by broken lines, are drawn by solid lines.

In FIG. 5, plural imaginary rhombic areas 10*x* in which the pressure chambers 10 (10*a*, 10*b*, 10*c*, 10*d*) are respectively contained are adjacently arranged in a matrix form in two directions, that is, arrangement direction A (first direction) and arrangement direction B (second direction), so that they do not overlap with one another and have the respective sides in common. The arrangement direction A is the longitudinal direction of the ink-jet head 1, that is, the extension direction of the sub-manifold 5*a* and is parallel to a short diagonal line of the rhombic area 10*x*. The arrangement direction B is a direction of one oblique side of the rhombic area 10*x* forming an obtuse angle with respect to the arrangement direction A. The pressure chamber 10 and the corresponding rhombic area 10*x* share the center position, and border lines of both are separate from each other when viewed on a plane.

The pressure chambers 10 adjacently arranged in a matrix form in the two directions of the arrangement direction A and the arrangement direction B are separate from each other by a distance equivalent to 37.5 dpi in the arrangement direction A. Besides, in one ink discharge area, 16 pressure chambers 10 are disposed in the arrangement direction B. The pressure chambers at both ends in the arrangement direction B are dummy and do not contribute to ink discharge.

The plural pressure chambers 10 disposed in a matrix form constitute plural pressure chamber lines in the arrangement direction A shown in FIG. 5. The pressure chamber lines are classified into a first pressure chamber line 11*a*, a second pressure chamber line 11*b*, a third pressure chamber line 11*c*, and a fourth pressure chamber line 11*d* according to the relative position to the sub-manifold 5*a* when viewed in a direction (third direction) vertical to the paper surface of FIG. 5. These first to fourth pressure chamber lines 11*a* to 11*d* are periodically arranged by fours in sequence of 11*c*→11*d*→11*a*→11*b*→11*c*→11*d*→ . . . →11*b* from the upper side of the actuator unit 21 to the lower side.

In pressure chambers 10*a* constituting the first pressure chamber line 11*a* and pressure chambers 10*b* constituting the second pressure chamber line 11*b*, when viewed in the third direction, with respect to a direction (fourth direction) orthogonal to the arrangement direction A, the nozzles 8 (nozzles 8*a* corresponding to the pressure chambers 10*a* and nozzles 8*b* corresponding to the pressure chambers 10*b*) are unevenly distributed on the lower side of the paper surface of FIG. 5. The nozzles 8 (8*a*, 8*b*) are respectively positioned at the lower ends of the corresponding rhombic areas 10*x*. On the other hand, in pressure chambers 10*c* constituting the third pressure chamber line 11*c* and pressure chambers 10*d* constituting the fourth pressure chamber line 11*d*, with respect to the fourth direction, the nozzles 8 (nozzles 8*c* corresponding to the pressure chambers 10*c* and nozzles 8*d* corresponding to the pressure chambers 10*d*) are unevenly distributed on the upper side of the paper surface of FIG. 5. The nozzles 8 (8*c*, 8*d*) are respectively positioned at the upper ends of the corresponding rhombic areas 10*x*. In the first and the fourth pressure chamber lines 11*a* and 11*d*, when viewed in the third direction, half or more of the pressure chambers 10*a* and 10*d* overlap with the sub-manifold 5*a*. In the second and the third pressure chamber lines 11*b* and 11*c*, when viewed in the third direction, none of areas of the pressure chambers 10*b* and 10*c* overlap with the sub-manifold 5*a*. Thus, with respect to the pressure chamber 10 belonging to any pressure chamber line, while the nozzle 8 communicating with this is made not to overlap with the sub-manifold 5*a*, the width of the sub-manifold 5*a* is made as wide as possible, and ink can be smoothly supplied to the respective pressure chambers 10.

Figure 6:
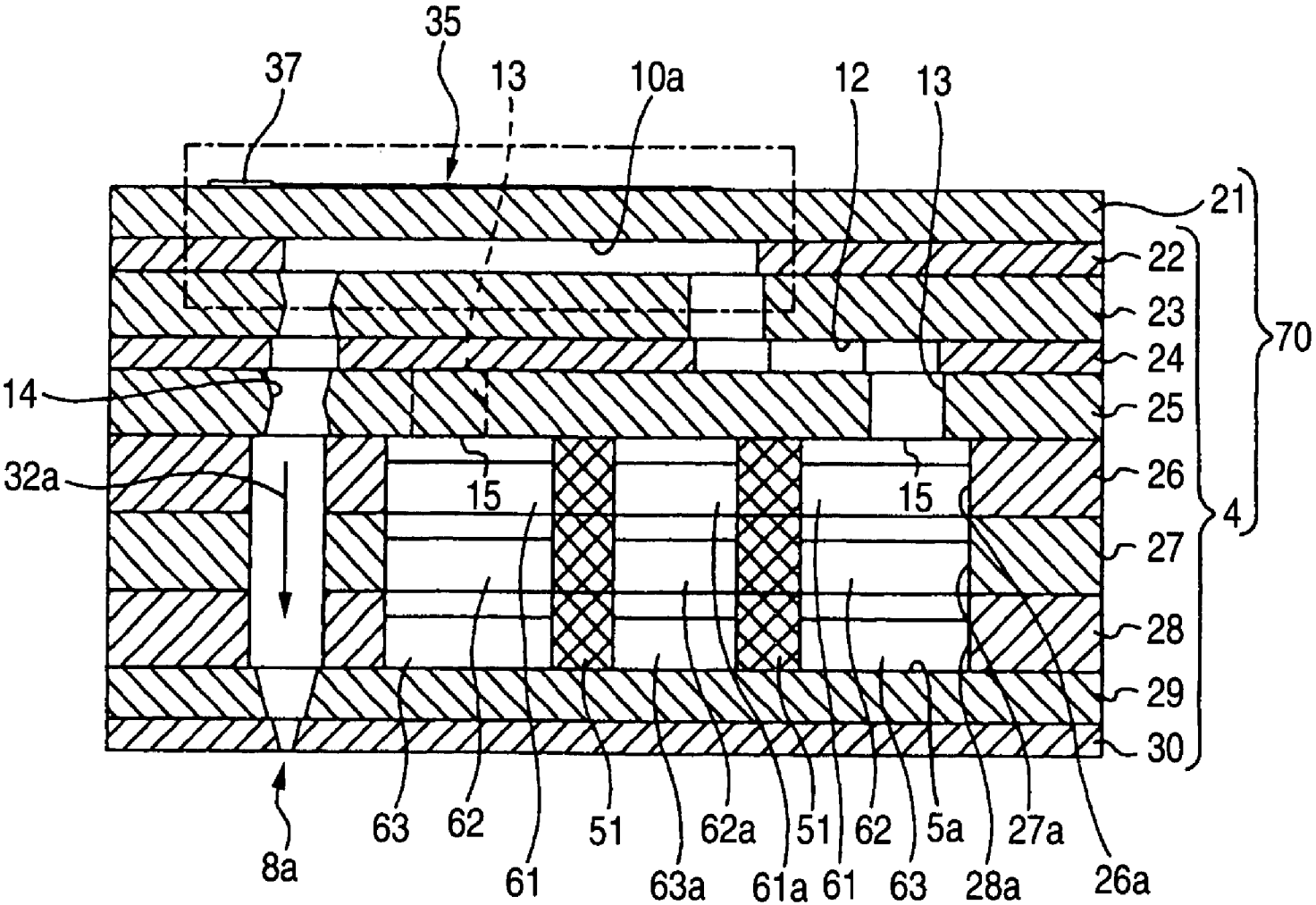
FIG. 6 is a sectional view taken along line VI—VI of FIG. 5.
Figure 7:
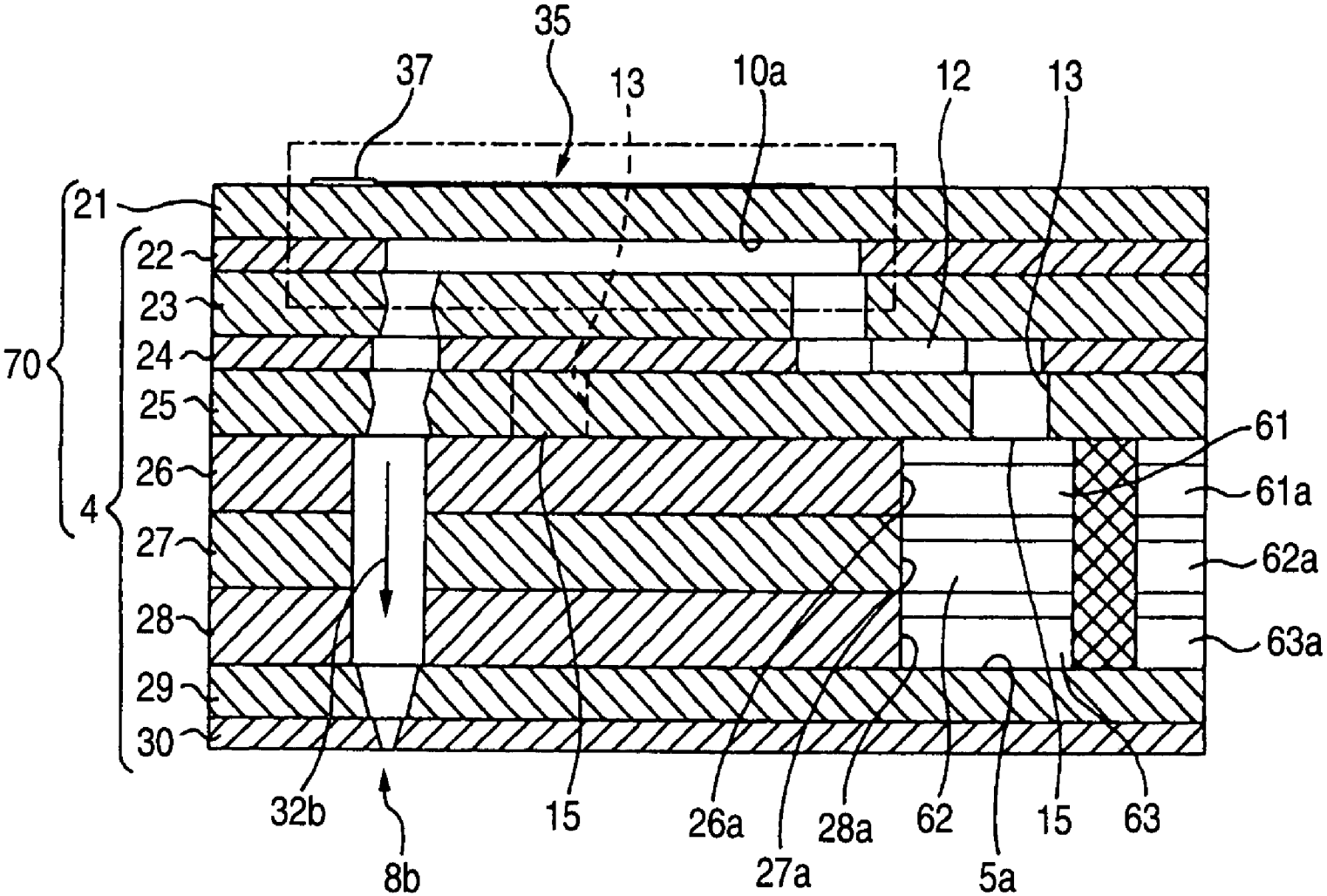
FIG. 7 is a sectional view taken along line VII—VII of FIG. 5.

Next, a sectional structure of the head main body 70 will be further described with reference to FIGS. 6 to 8. FIG. 6 is a sectional view taken along line VI—VI of FIG. 5 and shows the pressure chamber 10*a* belonging to the first pressure chamber line 11*a*. FIG. 7 is a sectional view taken along line VII—VII of FIG. 5 and shows the pressure chamber 10*b* belonging to the second pressure chamber line 11*b*. As is understood from FIGS. 6 and 7, each of the nozzles 8 (8*a*, 8*b*) communicates with the sub-manifold 5*a* through the pressure chamber 10 (10*a*, 10*b*), the aperture 12 and a communication hole 13. In this way, an individual ink flow path (32*a* denotes one corresponding to FIG. 6, and 32*b* denotes one corresponding to FIG. 7) extending from an outlet 15 of the sub-manifold 5*a* through the communication hole 13, the aperture 12 and the pressure chamber 10 to the nozzle 8 is formed for each of the pressure chambers 10.

As is apparent from FIGS. 6 and 7, the pressure chamber 10 and the aperture 12 are provided at different levels. By this, as shown in FIG. 5, in the flow path unit 4 corresponding to the ink discharge area under the actuator unit 21, the aperture 12 communicating with one pressure chamber 10 can be arranged in an overlap manner at the same position as the pressure chamber 10 adjacent to the one pressure chamber when viewed on a plane. As a result, since the pressure chambers 10 are arranged closely and at high density, high resolution image printing can be realized by the ink-jet head 1 having a relatively small occupied area.

Figure 8:
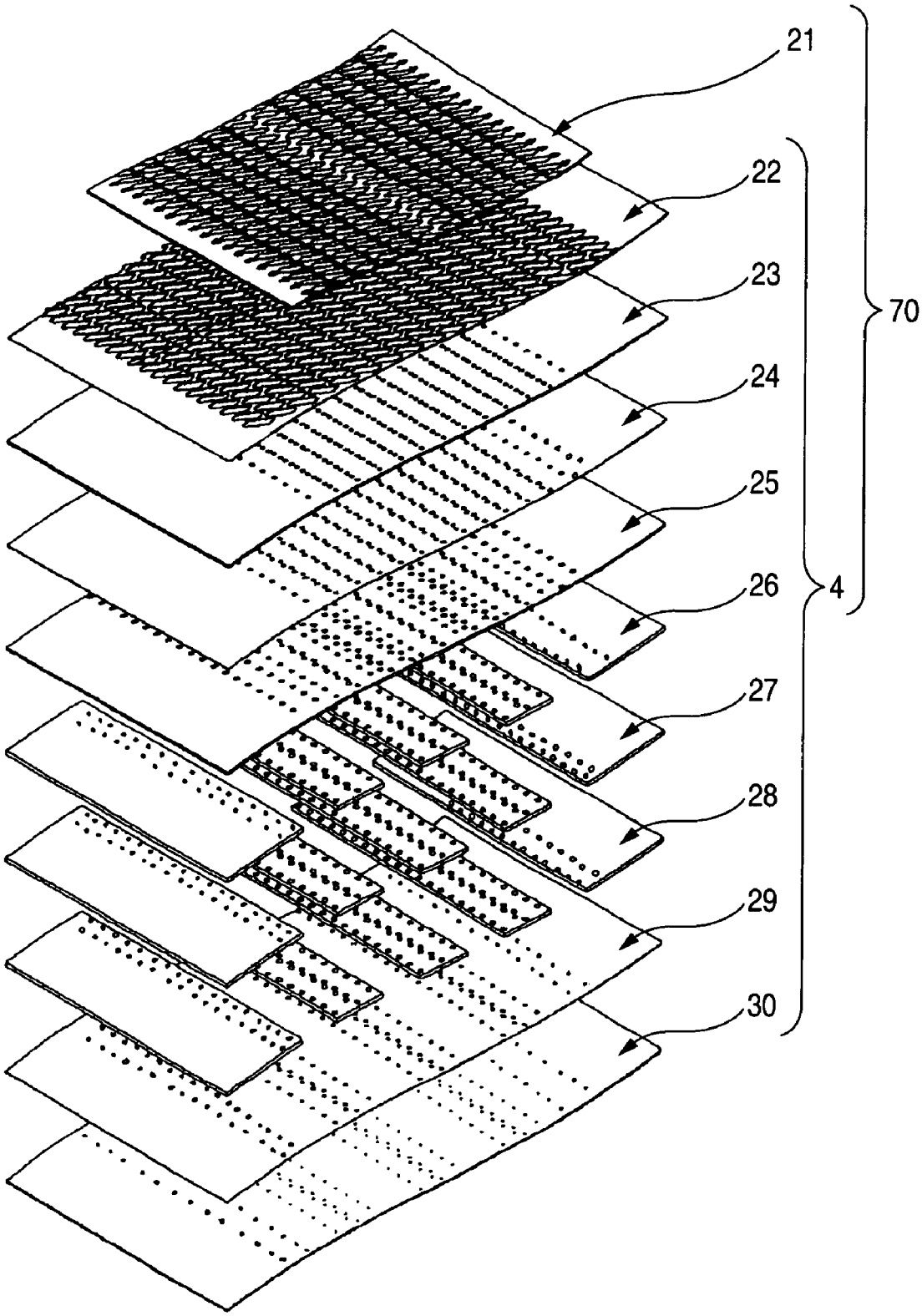
FIG. 8 is a partial exploded perspective view of a head main body shown in FIG. 6 and FIG. 7.

As is understood from FIG. 8, the head main body 70 has a lamination structure in which ten sheet-like members in total, that is, an actuator unit 21, a cavity plate 22, a base plate 23, an aperture plate 24, a supply plate 25, manifold plates 26, 27 and 28, a cover plate 29 and a nozzle plate 30 from the top are laminated through adhesive. Among these, the nine plates except the actuator unit 21 constitute the flow path unit 4.

As described later, the actuator unit 21 is such that four piezoelectric sheets 41 to 44 (see FIG. 11) are laminated and an electrode is disposed so that only the uppermost layer thereof is a layer (hereinafter simply referred to as "a layer including an active layer") having a portion which becomes an active layer at the time of electric field application, and the three remaining layers are non-active layers. The cavity plate 22 is a metal plate in which many substantially rhombic openings corresponding to the pressure chambers 10 are provided. The base plate 23 is a metal plate in which with respect to one of the pressure chambers 10 of the cavity plate 22, a communication hole between the pressure chamber 10 and the aperture 12 and a communication hole from the pressure chamber 10 to the nozzle 8 are provided. The aperture plate 24 is a metal plate in which with respect to one of the pressure chambers 10 of the cavity plate 22, in addition to the aperture 12, a communication hole from the pressure chamber 10 to the nozzle 8 is provided. The supply plate 25 is a metal plate in which with respect to one of the pressure chambers 10 of the cavity plate 22, the communication hole 13 for communicating the aperture 12 with the sub-manifold 5*a* and the communication hole 14 from the pressure chamber 10 to the nozzle 8 are provided. The manifold plates 26, 27 and 28 are metal plates in which through parts 26*a* to 28*a* constituting the sub-manifold 5*a* are respectively provided, and with respect to one of the pressure chambers 10 of the cavity plate 22, communication holes from the pressure chamber 10 to the nozzle 8 are respectively provided. The cover plate 29 is a metal plate in which with respect to one of the pressure chambers 10 of the cavity plate 22, a communication hole from the pressure chamber 10 to the nozzle plate 8 is provided. The nozzle plate 30 is a metal plate in which with respect to one of the pressure chambers 10 of the cavity plate 22, the nozzle 8 is provided.

These ten sheets 21 to 30 are positioned to each other and laminated so that the individual ink flow paths 32*a* and 32*b* as shown in FIGS. 6 and 7 are formed. Each of the individual ink flow paths 32*a* and 32*b* first goes upward from the sub-manifold 5*a*, extends horizontally in the aperture 12, and then, further goes upward, extends horizontally again in the pressure chamber 10, slightly goes obliquely downward in a direction of moving away from the aperture 12, and goes vertically downward toward the nozzle 8.

As is understood from FIGS. 6 and 7, the individual ink flow path 32*a* relating to the first pressure chamber 11*a* and the individual ink flow path 32*b* relating to the second pressure chamber 11*b* are different from each other in positional relation of the pressure chambers 10 to the sub-manifold 5*a*. Specifically, the pressure chamber 10*a* shown in FIG. 6 is opposite to the sub-manifold 5*a* in the lamination direction of the sheet-like members 21 to 30. On the other hand, the pressure chamber 10*b* shown in FIG. 7 is not opposite to the sub-manifold 5*a* in the same direction. Similarly, although a sectional view is omitted, as is understood from FIG. 5, the individual ink flow path 32*b* of the third pressure chamber line 11*c* and the individual ink flow path 32*a* of the pressure chamber line 11*d* are different from each other in positional relation of the pressure chambers 10 to the sub-manifold 5*a*, and the pressure chamber 10*d* is opposite to the sub-manifold 5*a* in the same direction, while the pressure chamber 10*c* is not opposite to the sub-manifold 5*a* in the same direction. The positional relation of the pressure chamber 10*a* to the sub-manifold 5*a* is the same as the positional relation of the pressure chamber 10*d* to the sub-manifold 5*a* except that the upper and lower parts are reversed with respect to the fourth direction. The positional relation of the pressure chamber 10*b* to the sub-manifold 5*a* is the same as the positional relation of the pressure chamber 10*c* to the sub-manifold 5*a* except that the upper and lower parts are reversed with respect to the fourth direction.

Thus, when no measures are taken, the compliances of the pressure chambers 10*a* and 10*d* at the time of an ink discharge operation become larger than the compliances of the pressure chambers 10*b* and 10*c*, and even if the same driving pulse is given, a difference occurs in ink discharge speeds from the nozzles 8 of both.

Figure 9:
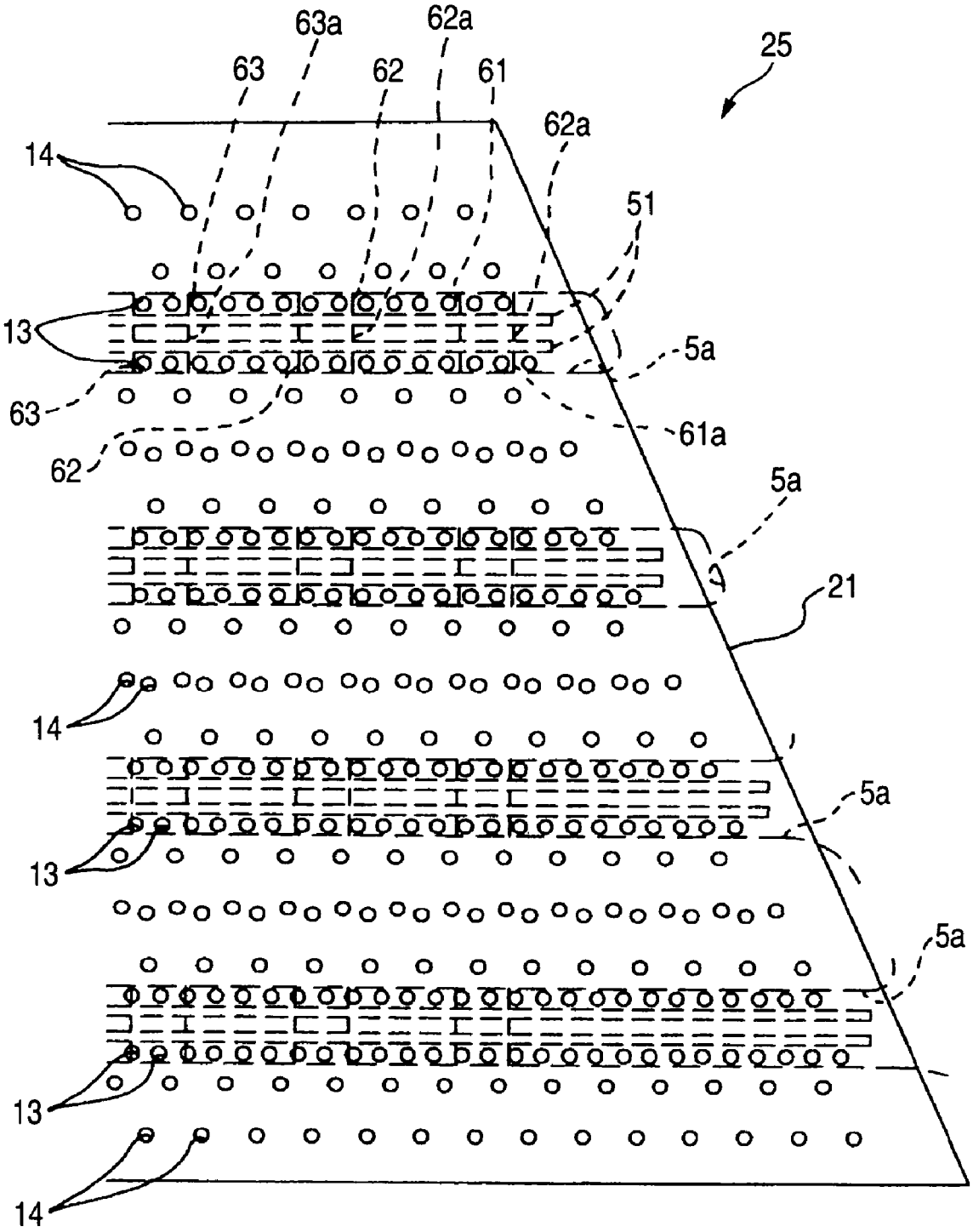
FIG. 9 is an enlarged view of the area surrounded by the one-dot chain line drawn in FIG. 4 and showing a supply plate constituting a flow path unit 4 viewed from above.
Figure 10:
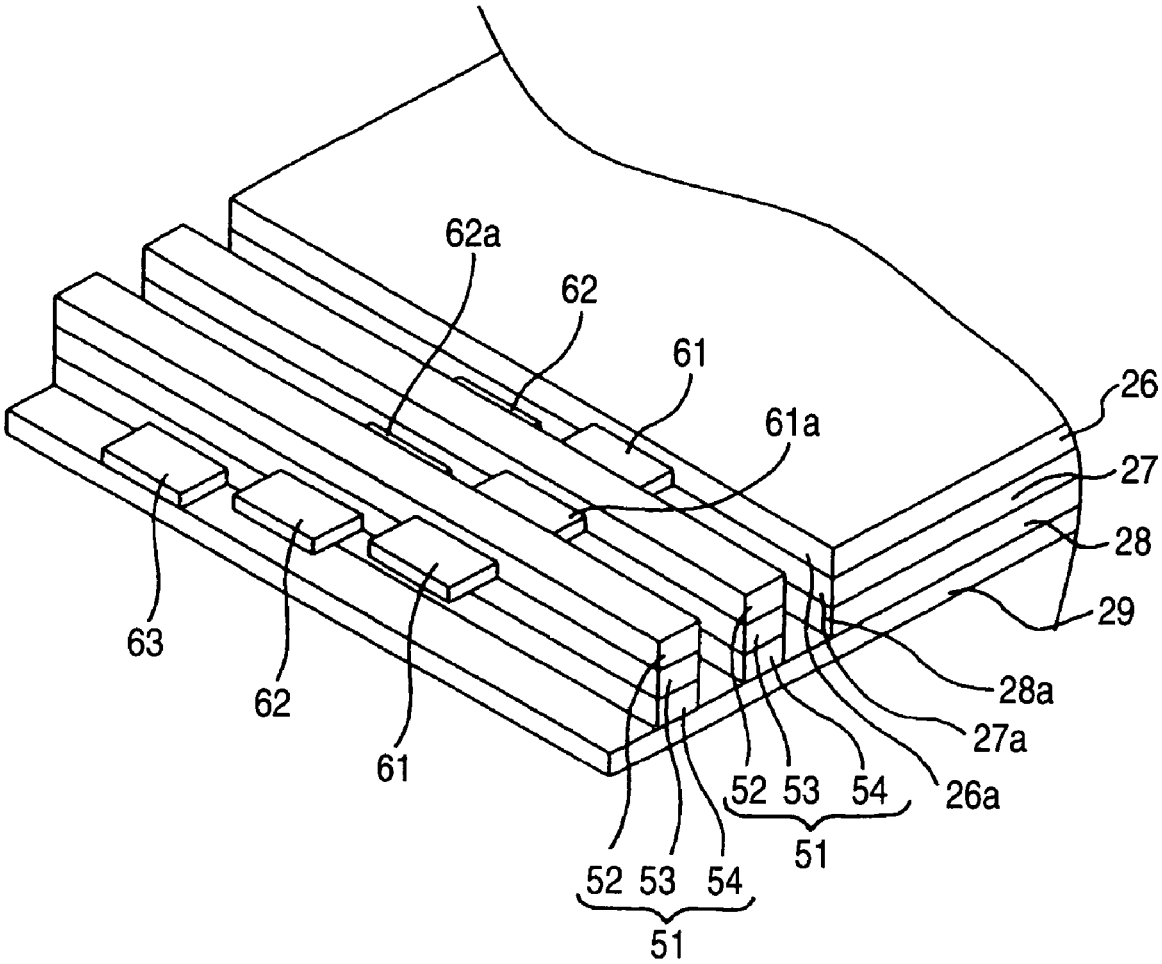
FIG. 10 is a perspective view showing a part in a sub-manifold shown in FIG. 6.

Then, in this embodiment, in each of the sub-manifolds 5*a* opposite to the pressure chambers 10*a* and 10*d*, two beams 51 connecting its upper surface and its lower surface are provided so that the compliances of the pressure chambers 10*a* and 10*d* at the time of the ink discharge become almost equal to the compliances of the pressure chambers 10*b* and 10*c*. FIG. 9 shows an area surrounded by a one-dot-chain line drawn in FIG. 4 and is an enlarged view showing the supply plate constituting the flow path unit 4 when viewed from above. FIG. 10 is a perspective view showing a part in the sub-manifold shown in FIG. 6. As shown in FIGS. 9 and 10, the two beams 51 extend in the longitudinal direction of the sub-manifold 5*a*, are separate from side surfaces (wall surfaces in the sub-manifold 5*a* constituted by the manifold plates 26 to 28) of the sub-manifold 5*a*, and are provided at positions not overlapping with the communication holes 13 (that is, the outlets 15 of the sub-manifold 5*a*) formed in the supply plate 25. Besides, the beams 51 are partially connected to connecting parts 61 to 63 protruding in parallel to the width direction of the sub-manifold 5*a* from the side surfaces of the sub-manifold 5*a*, and the two beams 51 are connected to each other by connecting parts 61*a* to 63*a* protruding in parallel to the width direction of the sub-manifold 5*a* from opposite surfaces of the beams 51. The connecting parts 61 to 63 are respectively formed for the respective manifold plates 26 to 28, are disposed not to exist on the same level, and are separate from each other in the longitudinal direction of the sub-manifold 5*a*. The connecting parts 61*a* to 63*a* connecting the beams 51 are also disposed not to exist on the same level similarly to the connecting parts 61 to 63, and are separate from each other in the longitudinal direction of the sub-manifold 5*a*.

As shown in FIG. 10, each of the beams 51 is divided into three parts in the lamination direction of the flow path unit 4, includes divided beams 52 to 54, and is constructed by bonding and laminating them. The divided beams 52 to 54, the connecting parts 61 to 63, and the connecting parts 61*a* to 63*a* are respectively formed for each of the manifold plates 26 to 28. That is, when the through part 26*a* constituting part of the sub-manifold 5*a* is formed, the manifold plate 26 is etched so that the, divided beam 52 and the connecting parts 61 and 61*a* remain. When the through part 27*a* constituting part of the sub-manifold 5*a* is formed, the manifold plate 27 is etched so that the divided beam 53 and the connecting parts 62 and 62*a* remain. When the through part 28*a* constituting part of the sub-manifold 5*a* is formed, the manifold plate 28 is etched so that the divided beam 54 and the connecting parts 63 and 63*a* remain. In this way, the divided beam 52 and the connecting parts 61 and 61*a* are integrally formed in the manifold plate 26, the divided beam 53 and the connecting parts 62 and 62*a* are integrally formed in the manifold plate 27, and the divided beam 54 and the connecting parts 63 and 63*a* are integrally formed in the manifold plate 28 By bonding and laminating the manifold plates 26 to 28 as stated above, the sub-manifold 5*a* is provided in the flow path unit 4, and the beams 51, the connecting parts 61 to 63, and the connecting parts 61*a* to 63*a* as shown in FIG. 10 are provided in the inside.

As stated above, since the beams 51 are partially connected to the side surfaces in the sub-manifold 5*a* by the connecting parts 61 to 63, ink can be made to flow in the longitudinal direction of the sub-manifold 5*a*, and ink flow path resistance in the longitudinal direction of the sub-manifold 5*a* can be reduced. Besides, since the divided beams 52 to 54, the connecting parts 61 to 63, and the connecting parts 61*a* to 63*a* are formed by merely etching the manifold plates 26 to 28, the sub-manifold 5*a* in which the beams 51 are provided can be easily produced. Besides, the beams 51 are made not to overlap with the outlet 15 of the sub-manifold 5*a*, when ink in the sub-manifold 5*a* is supplied to the pressure chamber 10, it is possible to prevent insufficient ink supply (under refill) from occurring. Since the upper surfaces of the connecting parts 61 and 61*a* formed for the manifold plate 26 are separate from the upper surface of the sub-manifold 5*a*, they do not prevent ink in the sub-manifold 5*a* from flowing to the pressure chamber 10 through the communication hole 13.

Next, the structure of the actuator unit 21 laminated on the cavity unit 22 of the uppermost layer of the flow path unit 4 will be described. FIG. 11 is an enlarged view of a portion surrounded by a one-dot chain line in FIG. 6, in which FIG. 11A is a sectional view and FIG. 11B is a plan view showing the shape of an individual electrode bonded to the surface of the actuator unit 21.

Figure 11A:
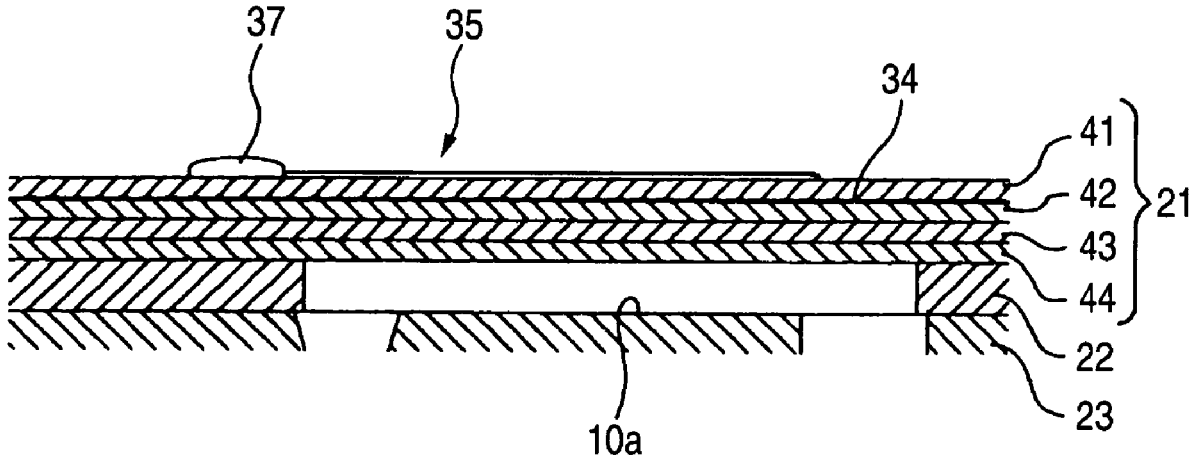
FIG. 11A is a sectional view and FIG. 11B is a plan view showing a shape of an individual electrode bonded to a surface of an actuator unit 21.
Figure 11B:
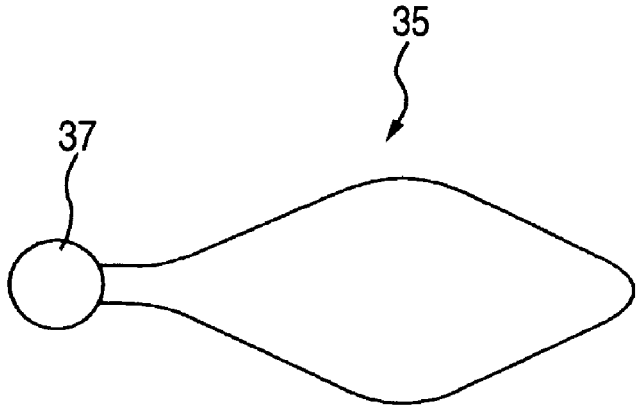

The actuator unit 21 shown in FIG. 11A includes four piezoelectric sheets 41 to 44 respectively formed to have a same thicknesses of about 15. m. These piezoelectric sheets 41 to 44 are continuous laminar flat plates (continuous flat layers) arranged to extend over the many pressure chambers 10 formed in one ink discharge area of the head main body 70. Since the piezoelectric sheets 41 to 44, as the continuous flat layers, are arranged to extend over the many pressure chambers 10, the individual electrodes 35 can be arranged on the piezoelectric sheet 41 at high density by using, for example, a screen printing technique. Thus, the pressure chambers 10 formed at positions corresponding to the individual electrodes 35 can also be arranged at high density, and printing of a high resolution image becomes possible. The piezoelectric sheets 41 to 44 are made of ceramic material of lead zirconate titanate (PZT) having ferroelectricity.

The individual electrode 35 is formed on the piezoelectric sheet 41 of the uppermost layer. A common electrode 34 formed on the whole surface of the sheet and having a thickness of about 2. m intervenes between the piezoelectric sheet 41 of the uppermost layer and the lower piezoelectric sheet 42. An electrode is not disposed between the piezoelectric sheet 42 and the piezoelectric sheet 43 and between the piezoelectric sheet 43 and the piezoelectric sheet 44.

Both the individual electrode 35 and the common electrode 34 are made of metal material such as Ag—Pd.

The individual electrode 35 has a thickness of approximately 1. m, and as shown in FIG. 11B, it has substantially a rhombic plane shape almost similar to the pressure chamber 10. One of acute angle parts of the substantially rhombic individual electrode 35 is extended, and its end is provided with a circular land part 37 electrically connected to the individual electrode 35 and having a diameter of about 160. m. The land part 37 is made of, for example, gold containing glass frit.

The common electrode 34 is grounded in a not-shown area By this, the common electrode 34 is equally kept at the ground potential in the areas corresponding to all the pressure chambers 10. Besides, the individual electrodes 35 are connected to the driver IC 80 through the FPC 50 including different lead lines independent for the respective individual electrodes 35, so that the potentials corresponding to the respective pressure chambers 10 can be controlled (see FIGS. 1 and 2).

Next, the driving method of the actuator unit 21 will be described. The polarization direction of the piezoelectric sheet 41 of the actuator unit 21 is its thickness direction. That is, the actuator unit 21 has a so-called unimorph type structure in which the upper (that is, far from the pressure chamber 10) one piezoelectric sheet 41 is made a layer in which an active layer exists, and the lower (that is, close to the pressure chamber 10) three piezoelectric sheets 42 to 44 are made non-active layers. Accordingly, when the individual electrode 35 is made to have a specified positive or negative potential, for example, when the electric field and the polarization are in the same direction, the electric field application portion sandwiched between the electrodes in the piezoelectric sheet 41 functions as the active layer (pressure generation part), and shrinks in the direction normal to the polarization direction according to a piezoelectric transverse effect. On the other hand, since the piezoelectric sheets 42 to 44 are not influenced by the electric field, they do not spontaneously shrink, and therefore, a difference in distortion in a direction vertical to the polarization direction occurs between the piezoelectric sheet 41 of the upper layer and the piezoelectric sheets 42 to 44 of the lower layers, and the whole of the piezoelectric sheets 41 to 44 is deformed to protrude toward the non-active side (unimorph deformation). At this time, as shown in FIG. 11A, since the lower surface of the piezoelectric sheets 41 to 44 is fixed to the upper surface of the cavity plate 22 for defining the pressure chamber, eventually, the piezoelectric sheets 41 to 44 are deformed to protrude toward the pressure chamber side. Thus, the volume of the pressure chamber 10 is reduced, the pressure of ink is raised, and the ink is discharged from the nozzle 8. Thereafter, when the individual electrode 35 is returned to have the same potential as the common electrode 34, the piezoelectric sheets 41 to 44 are returned to have the original shape, and the volume of the pressure chamber 10 is returned to the original volume, and therefore, ink is sucked from the manifold 5 side.

As another driving method, the individual electrode 35 is previously made to have a potential different from the common electrode 34, the individual electrode 35 is once made to have the same potential as the common electrode 34 each time a discharge request is made, and then, the individual electrode 35 can be made again to have the potential different from the common electrode 34 at specified timing. In this case, the piezoelectric sheets 41 to 44 are returned to have the original shape at the timing when the individual electrode 35 and the common electrode 34 have the same potential, so that the volume of the pressure chamber 10 is increased as compared with the initial state (state where the potentials of both the electrodes are different from each other), and ink is sucked from the manifold 5 side into the pressure chamber 10. Thereafter, the piezoelectric sheets 41 to 44 are deformed to protrude toward the pressure chamber 10 side at the timing when the individual electrode 35 is made again to have the potential different from the common electrode 34, and the volume of the pressure chamber 10 is reduced, so that the pressure to the; ink is raised, and the ink is discharged.

A return is made to FIG. 5, and consideration will be given to a band-like area R having a width (678.0 m) equivalent to 37.5 dpi in the arrangement direction A and extending in the arrangement direction B. In the band-like area R, only one nozzle 8 exists with respect to any line of the 16 pressure chamber lines 11*a* to 11*d*. That is, in the case where the band-like area R as stated above is defined at an arbitrary position in the ink discharge area corresponding to one actuator unit 21, 16 nozzles 8 are always distributed in this band-like area R. Positions of points obtained by projecting the 16 nozzles 8 onto a straight line extending in the arrangement direction A are spaced from each other by a distance equivalent to 600 dpi as the resolution at the time of printing.

When the 16 nozzles 8 are denoted by (1) to (16) in sequence from the left of positions obtained by projecting the 16 nozzles 8 belonging to the one band-like area R onto the straight line extending in the arrangement direction A, the 16 nozzles 8 are arranged in sequence of (1), (9), (5), (13), (2), (10), (6), (14), (3), (11), (7), (15), (4), (12), (8) and (16) from the bottom. In the ink-jet head 1 constructed as stated above, when the actuator unit 21 is suitably driven in accordance with the transport of a printing medium, a character or a drawing having a resolution of 600 dpi can be drawn.

A description will be given to a case where for example, a straight line extending in the arrangement direction A is printed at a resolution of 600 dpi. First, a description will be given in brief to a case of a reference example in which the nozzle 8 communicates with an acute angle part of the pressure chamber 10 at the same side. In this case, in response to the transport of the printing medium, discharge of ink is started from the nozzles 8 in the pressure chamber line located at the lowermost position in FIG. 5, and the nozzles 8 belonging to the upper adjacent pressure chamber line are sequentially selected and ink is discharged. By this, dots of ink are formed adjacently at intervals of 600 dpi in the arrangement direction A. Finally, the straight line extending in the arrangement direction A is drawn at a resolution of 600 dpi in total.

On the other hand, in this embodiment, discharge of ink is started from the nozzles 8 in the pressure chamber lines 11*b* positioned at the lowest part in FIG. 5, and in response to the transport of a printing medium, the nozzles 8 communicating with the upper adjacent pressure chambers are sequentially selected and ink is discharged. At this time, since displacements of positions of the nozzles 8 in the arrangement direction A at each time a shift is made to a higher adjacent pressure chamber line from a lower side to an upper side are not equal to each other, dots of ink sequentially formed in the arrangement direction A in response to the transport of the printing medium are not arranged at equal intervals of 600 dpi.

That is, as shown in FIG. 5, in response to the transport of the printing medium, first, ink is discharged from the nozzles (1) communicating with the lowermost pressure chamber line 11*b* in the drawing, and a line of dots are formed at intervals corresponding to 37.5 dpi on the printing medium. Thereafter, the printing medium is transported and when the formation position of the straight line reaches the position of the nozzle (9) communicating with the second pressure chamber line 11*a* from the bottom, ink is discharged from this nozzle (9). By this, a second ink dot is formed at a position which is displaced by a distance eight times the interval equivalent to 600 dpi from the first formed dot position in the arrangement direction A.

Next, the printing medium is transported and when the formation position of the straight line reaches the position of the nozzle (5) communicating with the third pressure chamber line 11*d* from the bottom, ink is discharged from the nozzle (5). By this, a third ink dot is formed at the position which is displaced by a distance four times the interval equivalent to 600 dpi from the first formed dot position in the arrangement direction A. Further, the printing medium is transported and when the formation position of the straight line reaches the position of the nozzle (13) communicating with the fourth pressure chamber line 11*c* from the bottom, ink is discharged from the nozzle (13). By this, a fourth ink dot is formed at a position which is displaced by a distance 12 times the interval equivalent to 600 dpi from the first formed dot position in the arrangement direction A. Further, the printing medium is transported and when the formation position of the straight line reaches a position of the nozzle (2) communicating with the fifth pressure chamber line 11*b* from the bottom, ink is discharged from the nozzle (2) By this, a fifth ink dot is formed at a position which is displaced by an interval equivalent to 600 dpi from the first formed dot position in the arrangement direction A.

Similarly, in the following, while sequentially selecting the nozzle 8 communicating with the pressure chamber 10 positioned at an upper side from a lower side in the drawing, ink dots are formed. At this time, when the number of the nozzle 8 shown in FIG. 5 is N, an ink dot is formed at a position which is displaced by a distance equivalent to (magnification n=N−1)×(interval equivalent to 600 dpi) from the first formed dot position in the arrangement direction A. Finally, when the 16 nozzles 8 have been selected, adjacent ink dots formed at intervals equivalent to 37.5 dpi by the nozzles (1) in the lowermost pressure chamber line 11*b* in the drawing are connected by 15 dots formed to be spaced from each other at intervals equivalent to 600 dpi, and it is possible to draw the straight line extending in the arrangement direction A at a resolution of 600 dpi in total.

Incidentally, in the vicinities of both ends (oblique sides of the actuator unit 21) of each of the ink discharge areas in the arrangement direction A, a complementary relation is established with the vicinities of, in the arrangement direction A, both ends of the ink discharge area corresponding to another opposite actuator unit 21 in the width direction of the head main body 70, so that printing at a resolution of 600 dpi becomes possible.

As stated above, in the ink-jet head 1, since the beams 51 are provided in the sub-manifold 5*a* of the flow path unit 4, the difference in compliance between the positional relation in which the pressure chamber 10 and the sub-manifold 5*a* are opposite to each other and the positional relation in which they are not opposite to each other can be almost eliminated. That is, when no measures are taken in the sub-manifold 5*a*, a difference in ink discharge speeds from the nozzles 8 occurs due to the difference in positional relation of the pressure chambers 10 to the sub-manifold 5*a*. However, since the beams 51 for connecting the upper surface and the lower surface are formed in the sub-manifold 5*a*, a drop in rigidity of a portion where the sub-manifold 5*a* of the flow path unit 4 is formed can be compensated. Thus, the rigidities of the lower portions of the respective pressure chambers 10 become almost equal to each other, and the difference in compliance can be almost eliminated. Since the longitudinal direction of the beams 51 and the arrangement direction A of the pressure chamber 10 are parallel to each other, the improvement of the rigidity in the longitudinal direction of the sub-manifold 5*a* by the beams 51 acts on the pressure chambers 10*a* and 10*d* and the difference in compliance can be effectively eliminated. Besides, since the beams 51 are separate from the side surfaces of the sub-manifold 5*a*, even if the arrangement pitch of the pressure chambers 10 is not particularly considered, the foregoing effect can be obtained, and accordingly, the design of the beams 51 becomes easy. Besides, since the two beams 51 are provided in parallel to each other, even in the case where the four lines of the pressure chamber lines 11*a* to 11*d* are provided as in this embodiment, part of the pressure chamber lines 11*a* and 11*d* opposite to the sub-manifold 5*a* overlap with the beams 51, and therefore, the difference in compliance can be effectively eliminated.

Figure 12:
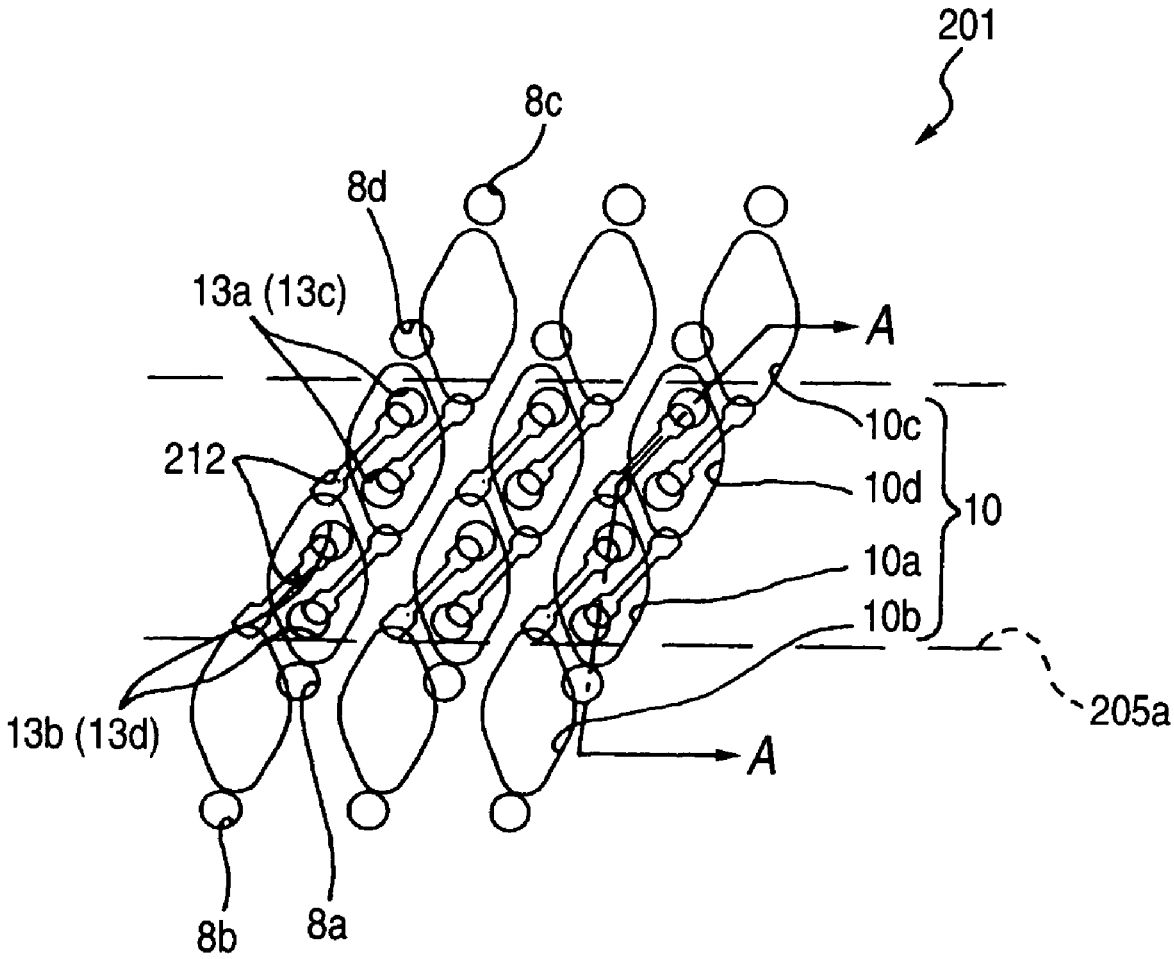
FIG. 12 is an enlarged view showing a main part of a flow path unit of an ink-jet head according to a second embodiment of the invention viewed from above.
Figure 13:
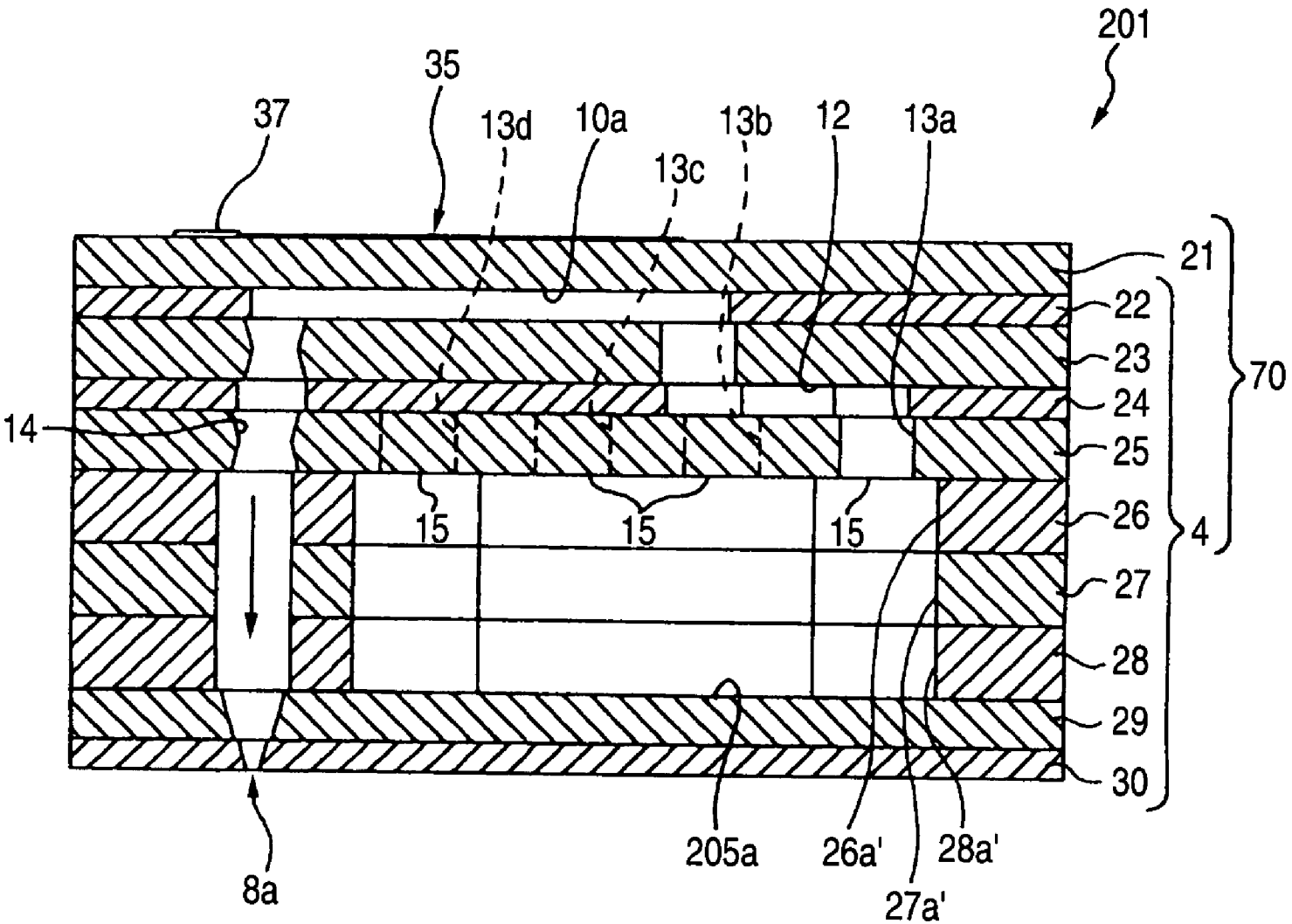
FIG. 13 is a sectional view taken along line A—A of FIG. 12.
Figure 14:
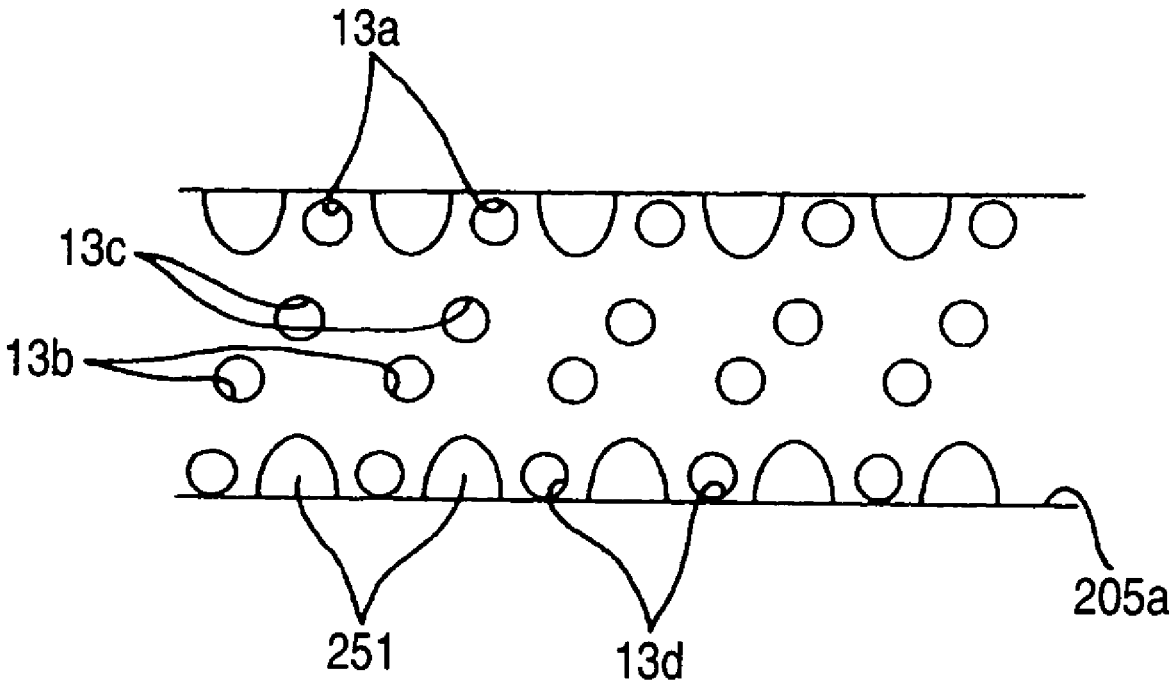
FIG. 14 is a view showing a part of a sub-manifold shown in FIG. 13 and viewed from above.

Next, an ink-jet head of a second embodiment will be described below. FIG. 12 is an enlarged view showing a main part of a flow path unit of the ink-jet head according to the second embodiment of the invention. FIG. 13 is a sectional view taken along line A—A of FIG. 12. FIG. 14 is a view of a part of a sub-manifold shown in FIG. 13 when viewed from above, and shows communication holes 13 formed in the supply plate 25, which are not originally seen. Incidentally, the same parts as those of the foregoing ink-jet head 1 are denoted by the same symbols and their description will be omitted.

Although an ink-jet head 201 of the second embodiment is almost equal to the foregoing ink-jet head 1, the inner structure of a flow path unit 4 is slightly different. That is, as shown in FIG. 12, an aperture 212 for communicating a sub-manifold 205*a*, which is extended in the longitudinal direction of the flow path unit 4 almost similarly to the foregoing sub-manifold 5*a*, with a pressure chamber 10 is formed in an aperture plate 24 to have an inclination angle almost equal to an inclination angle in a case where the aperture 12 of the foregoing ink-jet head 1 is rotated by about 90°. As shown in FIGS. 13 and 14, communication holes 13 formed in a supply plate 25 and for communicating the sub-manifold 205*a* with the apertures 212 are formed to be scattered in the width direction of the sub-manifold 205*a*. Besides, instead of the foregoing beams 51, protrusions 251 protruding from the side surfaces of the sub-manifold 205*a* toward the width direction are formed in the sub-manifold 205*a*. In these points, there is a different from the structure of the foregoing flow path unit 4.

As shown in FIG. 12 and FIG. 14, the communication holes 13 are respectively arranged to correspond to the pressure chambers 10 constituting first to fourth pressure chamber lines. That is, the communication holes 13*a* arranged on the upper side (area near one side surface of the sub-manifold 205*a*) in FIG. 14 communicate pressure chambers 10*a* constituting a pressure chamber line 11*a* with the sub-manifold 205*a*. Communication holes 13*d* arranged on the lower side (area near the other side surface of the sub-manifold 205*a*) in FIG. 14 communicate pressure chambers 10*d* constituting a pressure chamber line 11*d* with the sub-manifold 205*a*. In FIG. 14, communication holes 13*c* arranged at an upper side of a center area in the longitudinal direction of the sub-manifold 205*a* communicate pressure chambers 10*c* constituting a pressure chamber line 11*c* with the sub-manifold 205*a*. In FIG. 14, communication holes 13*b* arranged at a lower side of the center area in the longitudinal direction of the sub-manifold 205*a* communicates pressure chambers 10*b* constituting a pressure chamber line 11*b* with the sub-manifold 205*a*. As stated above, the communication holes 13*a* to 13*d* are arranged at the same pitch as the arrangement pitch of the respective pressure chambers 10 in the arrangement direction A so that they communicate with the pressure chambers 10*a* to 10*d* constituting the respective pressure chamber lines 11*a* to 11*d*.

Figure 15:
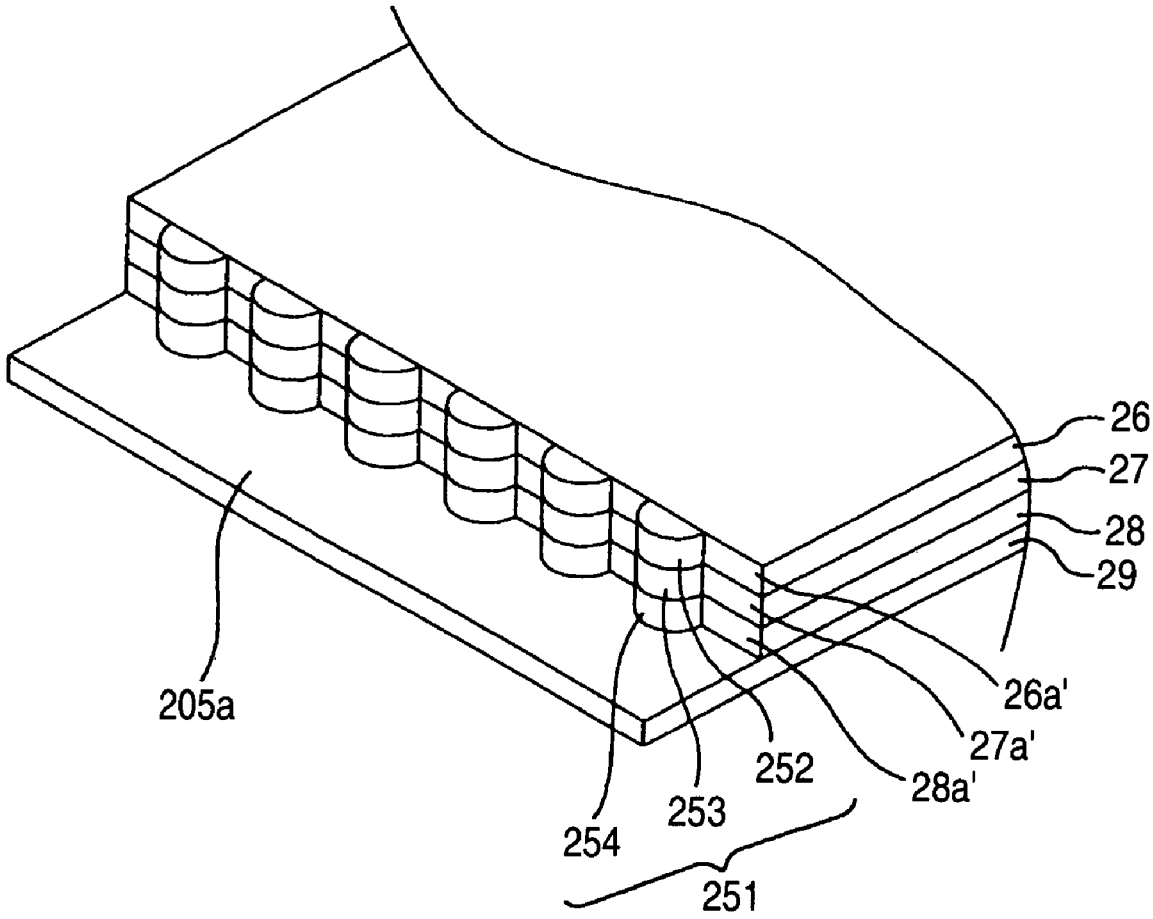
FIG. 15 is a perspective view showing a part in the sub-manifold shown in FIG. 13.

FIG. 15 is a perspective view showing a part of the sub-manifold shown in FIG. 13. As shown in FIG. 15, the plural protrusions 251 are formed from the side surface of the sub-manifold 205*a* in the longitudinal direction of the sub-manifold 205*a*, and are arranged to be separate from each other. The protrusions 251 connect the upper surface and the lower surface of the sub-manifold 205*a*. As shown in FIG. 14, the protrusions 251 are arranged in the longitudinal direction of the sub-manifold 205*a* between the communication holes 13*a* and 13*d* arranged to overlap with areas near the side surfaces of the sub-manifold 205*a*. Accordingly, since the protrusions 251 and the outlets 15 of the sub-manifold 205*a* do not overlap with each other, when ink in the sub-manifold 205*a* is supplied to the pressure chambers 10, it is possible to prevent insufficient ink supply (under refill) from occurring. Besides, since the protrusions 251 are arranged between the communication holes 13, the pitch of the protrusions 251 in the longitudinal direction of the sub-manifold 205*a* becomes equal to the arrangement pitch of the pressure chambers 10 in the arrangement direction A, and accordingly, the pitch of the protrusions 251 is determined by only determining the arrangement pitch of the pressure chambers 10 in the arrangement direction A, and the design of the formation positions of the protrusions 251 can be easily made.

Each of the protrusions 251 is divided into three parts in the lamination direction of the flow path unit 4 similarly to the foregoing beam 51, includes divided protrusions 252 to 254, and is constructed by bonding and laminating them. The divided protrusions 252 to 254 are provided for the manifold plates 26 to 28, respectively. That is, similarly to the foregoing beams 51, the connecting parts 61 to 63, and the connecting parts 61*a* to 63*a*, when through parts 26*a*' to 28*a*' constituting part of the sub-manifold 205*a* are formed, the respective manifold plates 26 to 28 are etched so that the divided protrusions 252 to 254 are formed.

Since the protrusions 251 as stated above are also provided in the sub-manifold 205*a* of the flow path unit 4, the difference in compliance between the positional relation in which the pressure chamber 10 and the sub-manifold 205*a* are opposite to each other and one in which they are not opposite to each other can be almost eliminated. That is, when no measures are taken in the sub-manifold 205*a*, a difference in ink discharge speeds from the nozzles 8 occurs due to the difference in the positional relation of the pressure chambers 10 to the sub-manifold 5*a*. However, since the protrusions 251 connecting the upper surface and the lower surface are formed in the sub-manifold 205*a*, a drop in rigidity of a portion in which the sub-manifold 5*a* of the flow path unit 4 is formed can be compensated. Thus, the difference in rigidity of the lower portions of the respective pressure chambers 10 becomes small, and the difference in compliance can be almost eliminated. Since the protrusions 251 are formed at both the side surfaces of the sub-manifold 5*a*, even in the case where the four pressure chamber lines exist and the two pressure chamber lines overlap with the sub-manifold 205*a* as in this embodiment, the protrusions 251 exist at positions where they overlap with the respective pressure chamber lines 11*a* and 11*d*, and therefore, the difference in compliance can be effectively eliminated as described above.

Besides, since the protrusions 251 protrude from the side surfaces of the sub-manifold 205*a* when viewed on a plane, and are merely formed between the communication holes 13 so as not to overlap with the communication holes 13, ink flowing in the sub-manifold 205*a* can be smoothly supplied to the pressure chambers 10. That is, when the whole width of the sub-manifold 205*a* is narrowed to increase the rigidity of the sub-manifold 205*a*, the amount of ink flowing in the sub-manifold 205*a* of the flow path unit 4 is reduced, and the resistance of the ink flow path is raised, so that the ink can not be smoothly supplied to the pressure chamber 10. However, since the protrusions 251 merely protrude from the side surfaces of the sub-manifold 205*a*, the maximum width of the sub-manifold 205*a* is not reduced, and accordingly, the amount of ink flowing in the sub-manifold 205*a* and existing in the sub-manifold 205*a* is hardly changed, and an increase in the resistance of the ink flow path is small, so that the ink can be smoothly supplied to the respective pressure chambers 10. When the protruding amount of the protrusion 251 in the width direction of the sub-manifold 205*a* is increased, the maximum width of the sub-manifold 205*a* can be increased while the rigidity of the sub-manifold 205*a* is kept, and a sufficient amount of ink to smoothly supply the ink to the respective pressure chambers 10 can be made to flow in the sub-manifold 205*a*.

Figure 16:
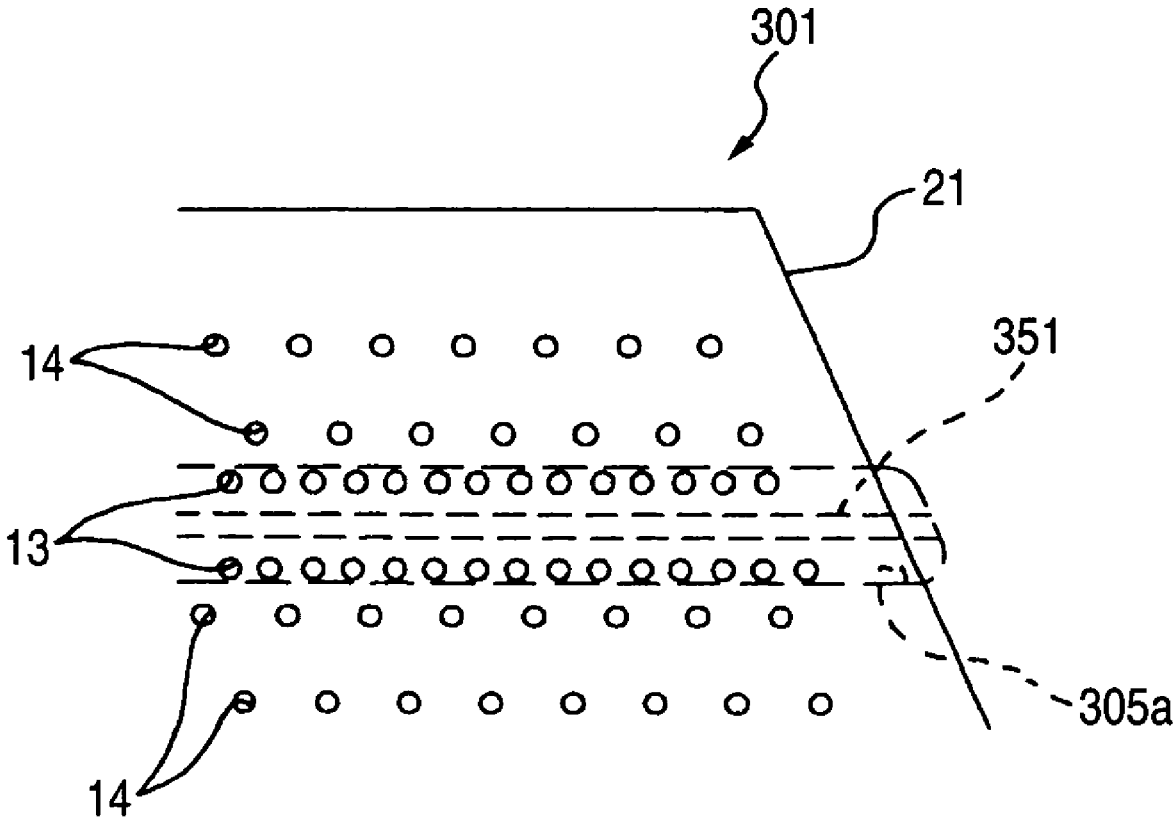
FIG. 16 is a main part enlarged view showing a state where a supply plate constituting a flow path unit of an ink-jet head according to a third embodiment of the invention is seen from above.
Figure 17:
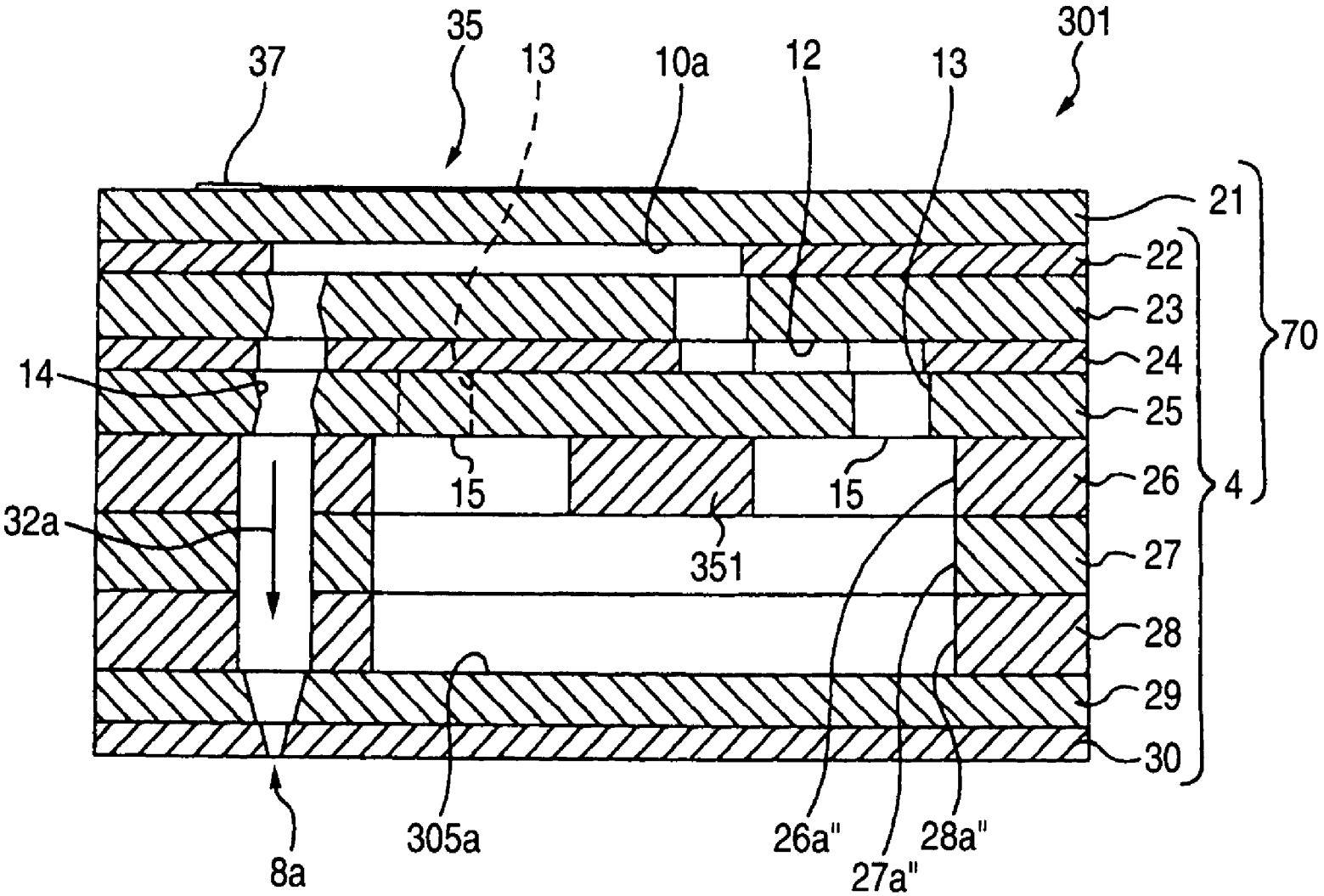
FIG. 17 is a view of a head main body of the ink-jet head according to the third embodiment of the invention and showing a section at a place similar to line VI—VI of FIG. 5.

Next, an ink-jet head of a third embodiment will be described below. FIG. 16 is a main part enlarged view showing a state where a supply plate constituting a flow path unit of the ink-jet head according to the third embodiment of the invention is seen from above, and FIG. 16 shows a part of an outer shape of an actuator unit 21 which is originally not seen. FIG. 17 is a view of a head main body of the ink-jet head according to the third embodiment of the invention and shows a section at the same place as line VI—VI of FIG. 5. Incidentally, the same parts as those of the foregoing ink-jet head 1 are denoted by the same symbols and their description will be omitted.

As shown in FIGS. 16 and 17, although an ink-jet head 301 of the third embodiment is almost equal to the foregoing ink-jet head 1, instead of the beams 51 provided in the foregoing sub-manifold 5*a*, a protrusion 351 protruding from an upper surface toward a lower part of a sub-manifold 305*a* is formed. As shown in FIG. 16, the protrusion 351 is extended in the longitudinal direction of a sub-manifold 305 and in parallel to a center area of the sub-manifold 305*a* in the width direction, and one end of the protrusion 351 is connected to the side surface of one end of the sub-manifold 305*a* in the longitudinal direction.

Besides, as shown in FIG. 17, the protrusion 351 is formed only in a manifold plate 26. That is, when a through part 26*a*" constituting a part of the sub-manifold 305*a* is formed in the manifold plate 26, the manifold plate 26 is etched so that the protrusion 351 remains. Besides, manifold plates 27 and 28 are etched similarly to the manifold plate 26 except the protrusion 351, and through parts 27*a*" and 28*a*" constituting the sub-manifold 305*a* are formed. The manifold plates 26 to 28 as stated above and the foregoing other plates are laminated, so that a flow path unit 4 is constructed, and the sub-manifold 305*a* in which the protrusion 351 is formed on the upper surface is formed in the flow path unit 4.

Since the protrusion 351 as described above is also provided in the sub-manifold 305*a* of the flow path unit, similarly to the foregoing, the difference in compliance between the positional relation in which the pressure chamber 10 and the sub-manifold 205*a* are opposite to each other and one in which they are not opposite to each other can be reduced. Although the protrusion 351 is not made to connect the upper surface and the lower surface of the sub-manifold 305*a*, since it is provided in the longitudinal direction of the sub-manifold 305*a* to extend across part of the upper surface opposite to plural pressure chambers 10*a* and 10*d* of the sub-manifold 305*a*, the rigidity of a portion of the flow path unit 4 where the sub-manifold 5*a* is formed, especially the rigidity of an upper surface portion of the sub-manifold 305*a* is improved, and accordingly, similarly to the foregoing embodiments, the difference in compliance can be reduced. Besides, only the protrusion 351 is provided in the sub-manifold 305*a*, the shape becomes simple, and manufacture is easy.

According to the ink-jet heads 1 and 201 of the first embodiment and the second embodiment, by the beams 51 and the protrusions 251 provided in the sub-manifolds 5*a* and 205*a*, the difference in compliance between the pressure chambers 10 due to the difference in positional relation of the pressure chambers to the sub-manifold 5*a*, 205*a* is almost eliminated, and ink discharge speeds from the nozzles 8 can be made uniform. Accordingly, variations in the ink discharge speeds from the nozzles 8 are almost eliminated, and the quality of a printing image by the ink-jet heads 1, 201 and 301 is extremely improved. Besides, according to the ink-jet head 301 of the third embodiment, by the projection 351 provided in the sub-manifold 305*a*, the difference in compliance between the pressure chambers 10 due to the difference in positional relation of the pressure chambers 10 to the sub-manifold 305*a* is eliminated, and the ink discharge speeds from the nozzles 8 can be made almost uniform. Accordingly, variations in the ink discharge speeds from the nozzles 8 are reduced, and the quality of a printing image by the ink-jet head 301 is improved.

In the above, although the preferred embodiments of the invention have been described, the invention is not limited to the foregoing embodiments, and various design changes can be made in the scope recited in the claims. For example, the shapes of the beams 51 and the protrusions 251 and 351 provided in the sub-manifolds of the embodiments are not particularly limited, and a reinforcing part for reducing the difference in compliance generated by the difference between the positional relation in which the pressure chamber 10 and the sub-manifold are opposite to each other and one in which they are not opposite to each other has only to be provided in the sub-manifold.

Besides, although each of the sub-manifolds 5*a*, 205*a* and 305*a* in the respective embodiments is constructed of the three manifold-plates 26 to 28, it may be constructed of one plate, or may be constructed of four or more plates. Although the two beams 51 are formed in the first embodiment, only one or not less than three beams may be formed. Although the connecting parts 61 to 63 for connecting the divided beams 52 to 54 constituting the beam 51 to the side surface of the sub-manifold are formed in one-to-one correspondence to the manifold plates 26 to 28, two or more connecting parts may be provided for one divided beam. Besides, with respect to the protrusions 251 in the second embodiment, only one protrusion, not plural protrusions, may be formed. Besides, with respect to the protrusion 351 in the third embodiment, plural protrusions separate from each other in the longitudinal direction of the sub-manifold 305*a* may be provided, and at this time, it is preferable that at least part of the protrusions overlap with portions of the upper surface of the sub-manifold opposite to the pressure chambers. By this, the foregoing difference in compliance can be reduced.

Further, although the ink-jet head of each of the foregoing embodiments is a line-type one, a serial-type ink-jet head may be adopted. Besides, the arrangement direction of the plural pressure chambers 10 arranged in a matrix form along the surface of the flow path unit 4 is not limited to the arrangement directions, A and B shown in FIG. 5, and as long as it is along the surface of the flow path unit 4, various directions may be adopted. The area in which the pressure chamber 10 is contained may have various shapes such as a parallelogram, not the rhombic shape, and the plane shape of the pressure chamber 10 itself contained therein may be suitably modified to have another shape. Besides, the flow path unit 4 may not be one formed by laminating plural sheet-like members.

The materials of the piezoelectric sheet and the electrode in the actuator unit 21 are not limited to the foregoing, and may be changed to different well-known materials. An insulating sheet other than the piezoelectric sheet may be used as the non-active layer. The number of layers including the active layer, and the number of non-active layers may be suitably changed, and in accordance with the lamination number of the piezoelectric sheets, the number of individual electrodes and common electrodes may be suitably changed. In the foregoing embodiments, although the common electrode is kept at the ground potential, as long as the potential is common to the respective pressure chambers 10, the common electrode is not limited to this.

Besides, in the actuator unit 21 of the foregoing embodiment, although the non-active layer is arranged at the pressure chamber side of the layer including the active layer, the layer including the active layer may be arranged at the pressure chamber 10 side of the non-active layer, or the non-active layer may not be provided. However, when the non-active layer is provided at the pressure chamber side of the layer including the active layer, it is expected that displacement efficiency of the actuator unit 21 is further improved.

In the above embodiments, as shown in FIG. 4, the two lines of the plural trapezoidal actuator units 21 are arranged in a staggered manner, however, the actuator unit may not always be made trapezoidal, and plural actuator units may be disposed merely in one line in the longitudinal direction of the flow path unit. Alternatively, three or more lines of actuator units may be arranged in a staggered manner. Besides, instead of arranging one actuator unit 21 to extend over the plural pressure chambers 10, one actuator unit 21 may be arranged for each of the pressure chambers 10.

Many common electrode 34 may be formed for the respective pressure chambers 10 so that a projection area to the lamination direction contains a pressure chamber area, or the projection area is contained in the pressure chamber area, and it is not always necessary that the common electrode is one conductive sheet provided in almost the whole area of one actuator unit 21. However, at this time, it is necessary that the common electrodes are electrically connected to each other so that all portions corresponding to the pressure chambers 10 have the same potential.

What is claimed is:

1. An ink-jet head comprising:

a flow path unit which includes a common ink chamber and plural individual ink flow paths extending from outlets of the common ink chamber through pressure chambers to nozzles, the plural pressure chambers being arranged along a plane so that positional relations between the common ink chamber and the pressure chambers are different from each other in the plural individual ink flow paths; and an actuator unit which is fixed to one surface of the flow path unit, and which changes volumes of the pressure chambers, wherein the common ink chamber includes a reinforcing part which reduces a difference in compliance between the plural pressure chambers corresponding to the plural individual ink flow paths having the different positional relations.

2. An ink-jet head according to claim 1, wherein the reinforcing part is at least partially connected to a wall surface, at a side of the one surface, of two wall surfaces opposite to the one surface among wall surfaces of the common ink chamber.

3. An ink-jet head according to claim 2, wherein the reinforcing part includes a beam separate from wall surfaces crossing the two opposite wall surfaces among the wall surfaces of the common ink chamber.

4. An ink-jet head according to claim 3, wherein the beam extends in parallel to a flow direction of ink flowing in the common ink chamber.

5. An ink-jet head according to claim 3, wherein a plurality of the beams parallel to each other are provided.

6. An ink-jet head according to claim 3, wherein the wall surfaces crossing the two opposite wall surfaces among the wall surfaces of the common ink chamber and the beam are partially connected to each other in an extension direction of the beam.

7. An ink-jet head according to claim 1, wherein the reinforcing part is provided in the common ink chamber to connect plural wall surfaces not existing on a same plane.

8. An ink-jet head according to claim 3, wherein the reinforcing part is connected between the two wall surfaces opposite to the one surface among the wall surfaces of the common ink chamber.

9. An ink-jet head according to claim 8, wherein the reinforcing part includes plural protrusions which protrude from at least one of two wall surfaces crossing the two opposite wall surfaces among the wall surfaces of the common ink chamber and are separate from each other in an extension direction of the common ink chamber.

10. An ink-jet head according to claim 9, wherein the plural protrusions protrude from at least the two wall surfaces crossing the two opposite wall surfaces among the wall surfaces of the common ink chamber.

11. An ink-jet head comprising:

a flow path unit provided with plural individual ink flow paths respectively including pressure chambers; and an actuator unit which is fixed to one surface of the flow path unit, and which changes volumes of the pressure chambers, wherein the flow path unit includes:

plural nozzles which discharges ink;

plural pressure chamber lines extending in parallel to each other, in which the plural pressure chambers communicating with the nozzles and each having a rectangular plane shape having two acute angle parts at a diagonal are arranged to be adjacent to each other; and plural common ink chambers extending in a direction parallel to the plural pressure chamber lines, wherein When viewed in a direction intersecting with the common ink chamber the plural pressure chamber lines include:

a first pressure chamber line formed of plural first pressure chambers in each of which one of acute angle parts communicates with a first nozzle and the other of the acute angle parts communicates with the common ink chamber;

a second pressure chamber line adjacent to the first pressure chambers and formed of plural second pressure chambers in each of which one of acute angle parts communicates with a second nozzle, and the other of the acute angle parts communicates with the common ink chamber;

a third pressure chamber line adjacent to the second pressure chambers and formed of plural third pressure chambers in each of which one of acute angle parts communicates with the common ink chamber, and the other of the acute angle parts communicates with a third nozzle; and a fourth pressure chamber line adjacent to the third pressure chambers and formed of plural fourth pressure chambers in each of which one of acute angle parts communicates with the common ink chamber, and the other of the acute angle parts communicates with a fourth nozzle, and a reinforcing part which reduces a difference in compliance between the first to the fourth pressure chambers is provided in the common ink chamber.

12. An ink-jet head according to claim 11, wherein the reinforcing part includes a beam which connects two wall surfaces opposite to the one surface among wall surfaces of the common ink chamber, is separate from two wall surfaces crossing the two opposite wall surfaces, and extends in parallel to a flow direction of ink flowing in the common ink chamber; and outlets of the common ink chamber respectively communicating with the first to the fourth pressure chambers are provided at positions not overlapping with the beam.

13. An ink-jet head according to claim 11, wherein the reinforcing part includes plural protrusions which connect two wall surfaces opposite to the one surface among wall surfaces of the common ink chamber, protrude from at least one of two wall surfaces crossing the two opposite wall surfaces, and are separate from each other in an extension direction of the common ink chamber, and the plural protrusions are provided at a same pitch as an arrangement pitch of the pressure chambers in the first to the fourth pressure chamber lines.

14. An ink-jet head according to claim 11, wherein the reinforcing part is at least partially connected to a wall surface, at a side of the one surface, of two wall surfaces opposite to the one surface among wall surfaces of the common ink chamber.

15. An ink-jet head according to claim 14, wherein the reinforcing part includes a beam separate from wall surfaces crossing the two opposite wall surfaces among the wall surfaces of the common ink chamber.

16. An ink-jet head according to claim 15, wherein the wall surfaces crossing the two opposite wall surfaces among the wall surfaces of the common ink chamber and the beam are partially connected to each other in an extension direction of the beam.

17. An ink-jet head according to claim 11, wherein the reinforcing part is provided in the common ink chamber to connect plural wall surfaces not existing on a same plane.

18. An ink-jet head according to claim 17, wherein the reinforcing part is connected between the two wall surfaces opposite to the one surface among the wall surfaces of the common ink chamber.

19. An ink-jet head according to claim 18, wherein the reinforcing part includes plural protrusions which protrude from at least one of two wall surfaces crossing the two opposite wall surfaces among the wall surfaces of the common ink chamber and are separate from each other in an extension direction of the common ink chamber.

20. An ink-jet head comprising:

a flow path unit provided with plural individual ink flow paths respectively including pressure chambers; and an actuator unit which is fixed to one surface of the flow path unit, and which changes volumes of the pressure chambers, wherein the flow path unit includes:

plural nozzles which discharges ink;

plural pressure chamber lines extending in parallel to each other, in which the plural pressure chambers communicating with the nozzles and each having a rectangular plane shape having two acute angle parts at a diagonal are arranged to be adjacent to each other; and plural common ink chambers extending in a direction parallel to the plural pressure chamber lines, wherein When viewed in a direction intersecting with the common ink chamber the plural pressure chamber lines include:

a first pressure chamber line formed of plural first pressure chambers in each of which one of acute angle parts communicates with a first nozzle and the other of the acute angle parts communicates with the common ink chamber;

a second pressure chamber line adjacent to the first pressure chambers and formed of plural second pressure chambers in each of which one of acute angle parts communicates with a second nozzle, and the other of the acute angle parts communicates with the common ink chamber;

a third pressure chamber line adjacent to the second pressure chambers and formed of plural third pressure chambers in each of which one of acute angle parts communicates with the common ink chamber, and the other of the acute angle parts communicates with a third nozzle; and a fourth pressure chamber line adjacent to the third pressure chambers and formed of plural fourth pressure chambers in each of which one of acute angle parts communicates with the common ink chamber, and the other of the acute angle parts communicates with a fourth nozzle, and a reinforcing part which reduces a displacement of the common ink chamber in laminating direction is provided in the common ink chamber.

* * * * *